US009235193B2

(12) United States Patent
Niwa et al.

(10) Patent No.: US 9,235,193 B2
(45) Date of Patent: Jan. 12, 2016

(54) TEMPERATURE COMPENSATION-TYPE BALANCE, TIMEPIECE MOVEMENT, MECHANICAL TIMEPIECE AND MANUFACTURING METHOD OF TEMPERATURE COMPENSATION-TYPE BALANCE

(71) Applicant: SEIKO INSTRUMENTS INC., Chiba (JP)

(72) Inventors: Takashi Niwa, Chiba (JP); Masahiro Nakajima, Chiba (JP); Takuma Kawauchiya, Chiba (JP); Hisashi Fujieda, Chiba (JP); Manabu Shinke, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 0 days.

(21) Appl. No.: 14/185,131

(22) Filed: Feb. 20, 2014

(65) Prior Publication Data

US 2014/0241134 A1 Aug. 28, 2014

(30) Foreign Application Priority Data

Feb. 25, 2013 (JP) ..... 2013-034703
Feb. 25, 2013 (JP) ..... 2013-034704

(51) Int. Cl.
*G04B 15/00* (2006.01)
*G04B 17/00* (2006.01)
*G04B 17/20* (2006.01)
(Continued)

(52) U.S. Cl.
CPC ..... *G04B 17/222* (2013.01); *G04B 17/20* (2013.01); *G04B 17/22* (2013.01); *G04B 17/063* (2013.01); *Y10T 29/49579* (2015.01)

(58) Field of Classification Search
CPC ..... G04B 17/06; G04B 17/063; G04B 17/20; G04B 17/22; G04B 17/222
USPC ..... 368/127, 168–171; 29/896.3, 31
See application file for complete search history.

(56) References Cited

U.S. PATENT DOCUMENTS 203,976 A * 5/1878 Woerd ..... 368/171
489,790 A * 1/1893 Carpenter ..... 368/171
(Continued)

FOREIGN PATENT DOCUMENTS

JP S4326014 11/1968

OTHER PUBLICATIONS

"Coefficients of Linear Expansion", Feb. 22, 2006, The Engineering Tool Box, <http://www.engineeringtoolbox.com/linear-expansion-coefficients-d_95.html>.*

*Primary Examiner* — Amy Cohen Johnson
*Assistant Examiner* — Daniel Wicklund
(74) *Attorney, Agent, or Firm* — Adams & Wilks

(57) ABSTRACT

A temperature compensation-type balance includes a balance staff, and a balance wheel having a plurality of bimetal portions disposed in parallel to each other in a circumferential direction around a rotation axis of the balance staff. Connection members connect respective ones of the plurality of bimetal portions and the balance staff. Each bimetal portion is a layered body in which a first member and a second member are radially overlapped, and one end portion in the circumferential direction is a fixed end connected to a respective connection member and the other end portion in the circumferential direction is a free end. The first member is formed of a ceramic material, and the second member is formed of a metal material having a thermal expansion coefficient different from that of the first member.

17 Claims, 21 Drawing Sheets

(51) Int. Cl.

| | |
|---|---|
| ***G04D 3/00*** | (2006.01) |
| ***G04B 17/22*** | (2006.01) |
| *G04B 17/06* | (2006.01) |

(56) References Cited

U.S. PATENT DOCUMENTS

| | | | | | |
|---|---|---|---|---|---|
| 965,506 | A * | 7/1910 | Ecaubert | 368/171 |
| 1,176,527 | A * | 3/1916 | Ecaubert | 368/171 |
| 1,859,866 | A * | 5/1932 | Werner | 368/171 |
| 2,116,257 | A * | 5/1938 | Aegler | 368/171 |
| 2,232,742 | A * | 2/1941 | Smith | 368/171 |
| 2,936,572 | A * | 5/1960 | Biemiller et al. | 368/171 |
| 8,414,184 | B2 * | 4/2013 | Mallet et al. | 368/170 |
| 2007/0140065 | A1 * | 6/2007 | Levingston | 368/127 |
| 2007/0201317 | A1 * | 8/2007 | Houlon | 368/281 |
| 2010/0034057 | A1 * | 2/2010 | Levingston | 368/175 |
| 2010/0054089 | A1 * | 3/2010 | Maier et al. | 368/169 |
| 2011/0103197 | A1 * | 5/2011 | Buhler et al. | 368/177 |
| 2012/0014229 | A1 * | 1/2012 | Mallet et al. | 368/170 |

* cited by examiner

Fig.32

| | METAL MATERIAL OF SECOND MEMBER | | | | | |
|---|---|---|---|---|---|---|
| CERAMIC MATERIAL OF FIRST MEMBER | Au | Cu | Ni | Ni ALLOY | Sn | Sn-Cu |
| Si | APPROX. 1,000°C | 500°C~ | 900~1100°C | 900~1100°C | 700~900°C | 500°C~ |
| SiC | APPROX. 1 000°C | 500°C~ | 900~1100°C | 900~1100°C | 700~900°C | 500°C~ |

TEMPERATURE COMPENSATION-TYPE BALANCE, TIMEPIECE MOVEMENT, MECHANICAL TIMEPIECE AND MANUFACTURING METHOD OF TEMPERATURE COMPENSATION-TYPE BALANCE

BACKGROUND OF THE INVENTION

1. Field of the Invention

The present invention relates to a temperature compensation-type balance, a timepiece movement, a mechanical timepiece and a manufacturing method of the temperature compensation-type balance.

2. Description of the Related Art

A speed regulator for a mechanical timepiece is generally configured to have a balance and a hairspring. Such a balance is a member which oscillates by cyclically rotating forward and backward around an axle of a balance staff, and it is important that an oscillation cycle thereof is set within a predetermined control value. This is because a rate of the mechanical timepiece (degree indicating whether the timepiece is fast or slow) varies if the oscillation cycle is beyond the control value. However, the oscillation cycle is likely to vary due to various causes, and for example, also varies due to a temperature change.

Here, an oscillation cycle T described above is expressed by the following Equation (1).

[Equation 1]

$$T = 2\pi\sqrt{\frac{I}{K}} \tag{1}$$

In Equation (1), the "moment of inertia of the balance" is indicated by I and a "spring constant of the hairspring" is indicated by K. Therefore, if the moment of inertia of the balance or the spring constant of the hairspring varies, the oscillation cycle also varies.

Here, a metal material used in the balance generally includes a material whose linear expansion coefficient is positive and which is expanded due to a temperature rise. Therefore, the balance wheel is radially enlarged to increase the moment of inertia. In addition, since the Young's modulus of a steel material which is generally used in the hairspring has a negative temperature coefficient, the temperature rise causes the spring constant to be lowered.

As described above, in a case of the temperature rise, the moment of inertia is increased accordingly and the spring constant of the hairspring is lowered. Therefore, as is apparent from Equation (1) described above, the oscillation cycle of the balance has characteristics of being shorter at a low temperature and being longer at a high temperature. For that reason, as temperature characteristics of the timepiece, the timepiece is fast at the low temperature and slow at the high temperature.

Therefore, as a measure to improve the temperature characteristics of the oscillation cycle of the balance, the following two methods have been known.

As the first method, there has been a known method where, in place of causing the balance wheel to be in a circle shape of a completely closed loop, the balance wheel is divided across two places in a circumferential direction to be arc-shaped portions, and each of the arc-shaped portions is formed of a bimetal where metal plates made of materials with a thermal expansion coefficient different from each other are radially bonded together, thereby setting the arc-shaped portions of which one end portion in the circumferential direction is a fixed end and the other end portion in the circumferential direction is a free end (refer to JP-B-43-26014 (Patent Reference 1)).

Generally, as described above, the balance wheel is radially enlarged due to thermal expansion along with a temperature rise, thereby increasing the effective moment of inertia. However, according to the first method, at the time of the temperature rise, the arc-shaped portions made of the bimetal are deformed inward so as to move the free end side radially inward due to a difference in the thermal expansion coefficient. This enables an average diameter of the balance wheel to be radially reduced and enables the effective moment of inertia to be lowered. Thus, it is possible to cause the temperature characteristics of the moment of inertia to have a negative slope. As a result, it is possible to change the moment of inertial to the extent of counter-balancing temperature dependence of the hairspring, thereby enabling the temperature dependence of the oscillation cycle of the balance to be lessened.

The second method is a method where a temperature coefficient of the Young's modulus near an operating temperature range (for example, 23° C.±15° C.) of the timepiece is caused to have positive characteristics by employing a constant elastic material such as Coelinvar as a material of the hairspring.

According to this second method, in the operating temperature range, it is possible to cancel the change in the moment of inertia of the balance with respect to the temperature by counter-balancing the linear expansion coefficient of the balance wheel and the linear expansion coefficient of the hairspring, thereby enabling the temperature dependence of the oscillation cycle of the balance to be lessened.

Incidentally, in the above-described first method, the arc-shaped portions made of the bimetal are formed by bonding the metal plates radially inward and the metal plates radially outward having a thermal expansion coefficient different from each other, and the bonding method can be exemplified such as brazing and crimping. However, in these methods, finishing depends on a bonding condition and the like thereat so that it is difficult to ensure constant form precision. Moreover, since the arc-shaped portions are configured of two metal plates, when performing the brazing and the crimping, or forming each of the arc-shaped portions by cutting, there is a possibility that two metal plates may be elastically deformed.

Due to these reasons, it is difficult for the arc-shaped portions made of the bimetal to be finished with the high form precision, and thus, adjusting the moment of inertial and setting a degree of temperature compensation are likely to be unstable. Additionally, an iron based material such as invar (low thermal expansion material) is generally employed as the material of the metal plate disposed radially inward, and this leads to a problem of generating rust unless plating and the like are not performed. Therefore, manufacturing needs labor, thereby leaving room for improvement.

In addition, in the above-described second method, there is a possibility that when manufacturing the hairspring using a constant elastic material such as Coelinvar, a temperature coefficient of the Young's modulus may vary greatly depending on composition during a melting process and various processing conditions during a heat treatment process or the like. Therefore, a strict manufacturing control process is required, thereby not facilitating the production of the hairspring. Accordingly, in some cases, it is difficult to cause the temperature coefficient of the Young's modulus to be positive near the operating temperature range of the timepiece.

SUMMARY OF THE INVENTION

The present invention is made in view of such circumstances, and an object thereof is to provide a temperature compensation-type balance which excels in the form precision, can be stably processed in temperature correction work as intended, is unlikely rust and can be efficiently manufactured while being suppressed from an unnecessary external force (stress) applied thereto; and a timepiece movement including the same; a mechanical timepiece and a manufacturing method of the temperature compensation-type balance.

The present invention provides the following means to solve the above problems.

(1) A temperature compensation-type balance according to the present invention includes a balance staff that rotates about an axle; and a balance wheel that has a plurality of bimetal portions which are disposed in parallel to each other in a circumferential direction around a rotational axle of the balance staff and extended in an arc shape along the circumferential direction of the rotational axle and connection members which radially connect each of the plurality of bimetal portions to the balance staff. The bimetal portion is a layered body in which a first member and a second member that is disposed more radially outward than the first member are radially overlapped, and one end portion in the circumferential direction is a fixed end connected to the connection member and the other end portion in the circumferential direction is a free end. The first member is formed of a ceramic material, and the second member is formed of a metal material having a thermal expansion coefficient different from that of the first member.

According to the temperature compensation-type balance of the invention, if a temperature is changed, the bimetal portion is radially bent and deformed with the fixed end as its starting point due to a difference in the thermal expansion coefficient between the first member and the second member, thereby enabling the free end of the bimetal portion to move radially inward or outward. In this manner, it is possible to change a position of the free end of the bimetal portion in a radial direction. This enables an average diameter of the balance wheel to be radially reduced or enlarged, and thus, it is possible to change the moment of inertial for the overall balance by changing a distance from the rotational axle of the balance staff. Accordingly, a slope of temperature characteristics in the moment of inertia can be changed, and thus, it is possible to perform a temperature correction.

Particularly, since the first member of the bimetal portion is formed of the ceramic material, it is possible to suppress the bimetal portion from being elastically deformed, and thus, even if the free end repeats to deform due to the temperature correction, it is possible to form a bimetal portion with time-dependently stable precision.

As described above, since the bimetal portion can be formed with excellent form precision while preventing the elastic deformation, temperature correction work can be stably performed as intended, and thus, it is possible to provide a high quality balance that is unlikely to vary in a rate influenced by the temperature change and excels in temperature compensation performance.

In addition, a shape of the bimetal portion can be controlled, thereby enabling a degree of freedom in the shape of the bimetal portion to be enhanced. For example, a volume of the temperature compensation is likely to be controlled by increasing a displacement. In addition, the first member is made of the ceramic material, thereby being unlikely to rust, even if plating is not performed. Accordingly, there is no need of a step of plating, thereby enabling the first member to be efficiently manufactured.

In addition, in the bimetal portion configured to include the first member and the second member which are radially overlapped with each other, since the inward first member is formed of the ceramic material, a thermal deformation of the first member caused by the temperature change is suppressed, and thus, the deformation of the bimetal portion which is associated with the temperature change is suppressed to be low, and it is possible to obtain a desired adjustment volume in the moment of inertia. That is, since the inward member of the bimetal portion is made of the ceramic material but metal, it is possible to design a deformation volume of the free end portion of the bimetal without excessively considering a thermal deformation volume of the inward member.

Accordingly, the temperature correction for the moment of inertia can be easily performed, thereby enabling correction precision to be improved.

(2) In the temperature compensation-type balance according to the invention, it is preferable that the first member and the connection member be formed to be integrated with each other using the ceramic material, and the second member be an electrocast made of the metal material having the thermal expansion coefficient different from that of the first member.

In this case, the connection member and the first member that configures the bimetal portion in the balance wheel are formed to be integrated with each other using the ceramic material, and thus, for example, it is possible to form the connection member and the first member to be integrated with each other in the excellent form precision from a silicon substrate by utilizing a semiconductor manufacturing technology (technology including photolithography technique and etching processing technology). Besides, utilizing the semiconductor manufacturing technology enables the connection member and the first member to be formed in a desired minute shape without applying an unnecessary external force thereto. Meanwhile, the second member configuring the bimetal portion is the electrocast, thereby being able to be bonded to the first member through easy work of simply spreading the metal material by electrocasting. Therefore, unlike a method of brazing or crimping in the related art, still without applying the unnecessary external force to the first member, the second member can be bonded thereto. Therefore, in addition to preventing the elastic deformation of the bimetal portion, it is possible to form the bimetal portion with the excellent form precision.

(3) In the temperature compensation-type balance according to the invention, it is preferable that the second member have a second engagement portion that is engaged with a first engagement portion formed in the first member and be bonded to the first member as maintaining the engagement therebetween.

In this case, a bonding intensity between the first member and the second member can be enhanced by the engagement of the first engagement portion and the second engagement portion, thereby enabling an operational reliability as the bimetal portion to be improved. In addition, the engagement between both of the engagement portions determines a position of the second member in the circumferential direction with respect to the first member, and thus, the second member can be bonded to a region lead by the first member. In this respect as well, it is possible to improve the operational reliability as the bimetal portion.

(4) In the temperature compensation-type balance according to the invention, it is preferable that the first member and the second member be bonded via an alloy layer.

In this case, the first member and the second member are bonded via the alloy layer, and thus, it is possible to enhance the bonding intensity between both of the members, and it is possible to improve the operational reliability as the bimetal portion.

(5) In the temperature compensation-type balance according to the invention, it is preferable that a weight portion be provided at the free end of the bimetal portion.

In this case, a weight of the free end of the bimetal portion can be increased by the weight portion, and thus, with respect to a change volume of the free end in the radial direction, it is possible to more effectively perform the temperature correction for the moment of inertia. Therefore, the temperature compensation performance is more likely to be improved.

(6) In the temperature compensation-type balance according to the invention, it is preferable that the first member and the connection member be formed of any material among Si, SiC, $SiO_2$, $Al_2O_3$, $ZrO_2$ and C.

In this case, as the ceramic material, Si, SiC, $SiO_2$, $Al_2O_3$, $ZrO_2$ or C is employed, thereby enabling the etching processing, particularly, enabling dry etching processing to be preferably performed. Therefore, it is possible to form the connection member and the first member more easily and efficiently, thereby being likely to further enhance manufacturing efficiency.

(7) In the temperature compensation-type balance according to the invention, it is preferable that the second member be formed of any material among Au, Cu, Ni, an Ni alloy, Sn and a Sn alloy.

In this case, as the metal material, Au, Cu, Ni, the Ni alloy, Sn or the Sn alloy is employed, and thus, it is possible to smoothly spread the metal material by electrocasting and to efficiently form the second member. Therefore, it is likely to further enhance manufacturing efficiency.

(8) A temperature compensation-type balance according to the present invention includes a balance staff that rotates about an axle; and a balance wheel that has a plurality of bimetal portions which are disposed in parallel to each other in a circumferential direction around a rotational axle of the balance staff and extended in an arc shape along the circumferential direction of the rotational axle and connection members which radially connect each of the plurality of bimetal portions to the balance staff. The bimetal portion is a layered body in which a first member and a second member having a thermal expansion coefficient different from each other are radially overlapped, and one end portion in the circumferential direction is a fixed end connected to the connection member and the other end portion in the circumferential direction is a free end. The bimetal portion becomes gradually thinner in thickness along the radial direction as being from the fixed end side toward the free end side.

According to this configuration, if a temperature is changed, the bimetal portion is radially bent and deformed with the fixed end as its starting point due to a difference in the thermal expansion coefficient between the first member and the second member, thereby enabling the free end of the bimetal portion to move radially inward or outward. In this manner, it is possible to change a position of the free end of the bimetal portion in a radial direction. This enables an average diameter of the balance wheel to be radially reduced or enlarged, and thus, it is possible to change the moment of inertial for the overall balance by changing a distance from the rotational axle of the balance staff. Accordingly, a slope of temperature characteristics in the moment of inertia can be changed, and thus, it is possible to perform a temperature correction.

Here, since the bimetal portion becomes gradually thinner in the thickness along the radial direction as being from the fixed end side toward the free end side, the bimetal portion is likely to deform as being from the fixed end side toward the free end side. Specifically, as being toward the free end side, the bimetal portion deforms so as to be radially tilted. Therefore, a change amount along the radial direction (hereinafter, simply refer to as a change amount in radius) on the free end side of the bimetal portion becomes large compared to the change amount in radius on the fixed end side. Accordingly, the change amount in radius on the free end side can be increased while maintaining the thickness on the fixed end side. Thus, it is possible to first ensure the intensity and ensure the necessary temperature correction amount of the moment of inertia.

Therefore, it is possible to prevent the bimetal portion from being elastically deformed or being damaged due to a shock and stably perform temperature correction work as intended, and thus, it is possible to provide a high quality balance which is unlikely to vary in a rate influenced by the temperature change and excels in temperature compensation performance.

(9) In the temperature compensation-type balance according to the invention, the first member may be disposed more radially inward than the second member and formed of a ceramic material to be integrated with the connection member. At least the first member between the first member and the second member may become gradually thinner in the thickness along the radial direction as being from the fixed end side toward the free end side.

According to this configuration, the balance can be made through a semiconductor process such as a photolithography technique by forming the connection member and the first member using the ceramic material such as silicon. In this case, compared to a case of making the connection member or the first member through a mechanical processing, a high-precision balance having a high degree of freedom in the shape can be provided. In addition, it is possible to form the connection member and the first member more easily and efficiently, thereby being likely to further enhance manufacturing efficiency.

Then, since at least the first member between the first member and the second member is formed gradually thinner as being from the fixed end side toward the free end side, even in a case of forming the first member using the ceramic material that is a brittle material, it is possible to first ensure the intensity on the fixed end side and ensure the change amount in radius.

(10) In the temperature compensation-type balance according to the invention, a thickness ratio of the first member to the second member in the radial direction may be uniform from the fixed end side to the free end side.

According to this configuration, a deformation degree of the first member and the second member becomes uniform from the fixed end side to the free end side based on the thermal expansion coefficient and the Young's modulus. That is, it is possible to suppress the deformation degree influenced by a difference of the thickness ratio from being deviated. Thus, it is possible to stably deform the bimetal portion, and a length of the bimetal portion along the circumferential direction is likely to be set in accordance with the necessary temperature correction amount of the moment of inertia.

(11) In the temperature compensation-type balance according to the invention, a weight portion may be provided at the free end of the bimetal portion.

According to this configuration, since a weight of the free end of the bimetal portion can be increased by the weight portion, with respect to the change amount in radius of the free end, it is possible to more effectively perform the temperature correction of the moment of inertia. Therefore, the temperature compensation performance is likely to be further improved.

(12) A timepiece movement according to the invention includes a movement barrel that has a power source; a train wheel that transfers a rotational force of the movement barrel; an escapement mechanism that controls rotations of the train wheel; and the temperature compensation-type balance according to the invention controlling a speed of the escapement mechanism.

The timepiece movement according to the invention is provided with the temperature compensation-type balance having the high temperature compensation performance as described above, and thus, it is possible to provide a high quality timepiece movement having few errors in the rate.

(13) A mechanical timepiece according to the invention includes the timepiece movement according to the invention.

The mechanical timepiece according to the invention is provided with the above-described timepiece movement, and thus, it is possible to provide a high quality mechanical timepiece having few errors in the rate.

(14) A method of manufacturing the temperature compensation-type balance according to the invention is a manufacturing method of the temperature compensation-type balance including a step of processing a substrate in which a ceramic substrate is processed by a semiconductor manufacturing technology to connect the plurality of first members to the connection members to be integrated with each other, and a precursor is formed in which a guide wall for electrocasting which defines an open space for electrocasting between the guide wall and each of the first members is connected to each of the first members to be integrated therewith; a step of electrocasting in which a metal material spreads in the open space for electrocasting on the precursor by electrocasting so as to form the second member and to form the bimetal portion in which the first member and the second member are radially overlapped and bonded; and a step of removing in which the guide wall for electrocasting is removed from the first member.

In the method of manufacturing the temperature compensation-type balance according to the invention, it is possible to achieve the similar operation effect as the above-described temperature compensation-type balance. That is, since the bimetal portion can be formed with the excellent form precision while preventing the elastic deformation, it is possible to stably perform the temperature correction work as intended. Therefore, it is possible to provide a high quality balance that is unlikely to vary in the rate influenced by the temperature change and excels in the temperature compensation performance.

Particularly, at the time of the step of processing the substrate, in addition to the connection member and the first member, the precursor is formed to which the guide wall for electrocasting is connected to be integrated therewith. Therefore, the open space for electrocasting defined between the guide wall for electrocasting and the first member can be formed with the excellent form precision. Then, at the time of the step of electrocasting, the second member is formed by spreading the metal material in the open space for electrocasting, thereby enabling the second member to be formed with the excellent form precision. As a result, it is possible to obtain the high quality bimetal portion having a desired shape. In this manner, it is possible to more markedly exhibit the above-described operation effect.

(15) In the manufacturing method of the temperature compensation-type balance according to the invention, it is preferable that a step of heat treatment in which the precursor having the bimetal portion formed therein be heat-treated during a predetermined period at a predetermined temperature atmosphere, after the step of electrocasting.

In this case, since the heat treatment is performed after forming the bimetal portion by bonding the second member to the first member through the electrocasting, it is possible to diffuse the metal material forming the second member which is the electrocast along a bonding interface with respect to the first member, and thus, it is possible to form the alloy layer between the first member and the second member by utilizing this diffusion. In this manner, the first member and the second member can be bonded to each other via the alloy layer, thereby enabling the bonding intensity of both of the members to be enhanced. Therefore, it is possible to improve the operational reliability as the bimetal portion.

According to the present invention, it is possible to provide a temperature compensation-type balance which excels in form precision, can be stably processed in temperature correction work as intended, is unlikely rust, can be efficiently manufactured while being suppressed from an unnecessary external force (stress) applied thereto and has the enhanced temperature compensation performance.

BRIEF DESCRIPTION OF THE DRAWINGS

FIG. 16 is turned upside down and is pasted on an adhesion layer of a first support substrate.

FIG. 32 illustrates an example of a combination between a material of a first member and a material of the second member which configure the bimetal portion according to the invention, and illustrates the most suitable temperature for heat treatment in each of the combinations.

DETAILED DESCRIPTION OF THE PREFERRED EMBODIMENTS

Hereinafter, an embodiment according to the present invention will be described with reference to the drawings.

[Configuration of Mechanical Timepiece, Timepiece Movement and Temperature Compensation-Type Balance]

Figure 1:
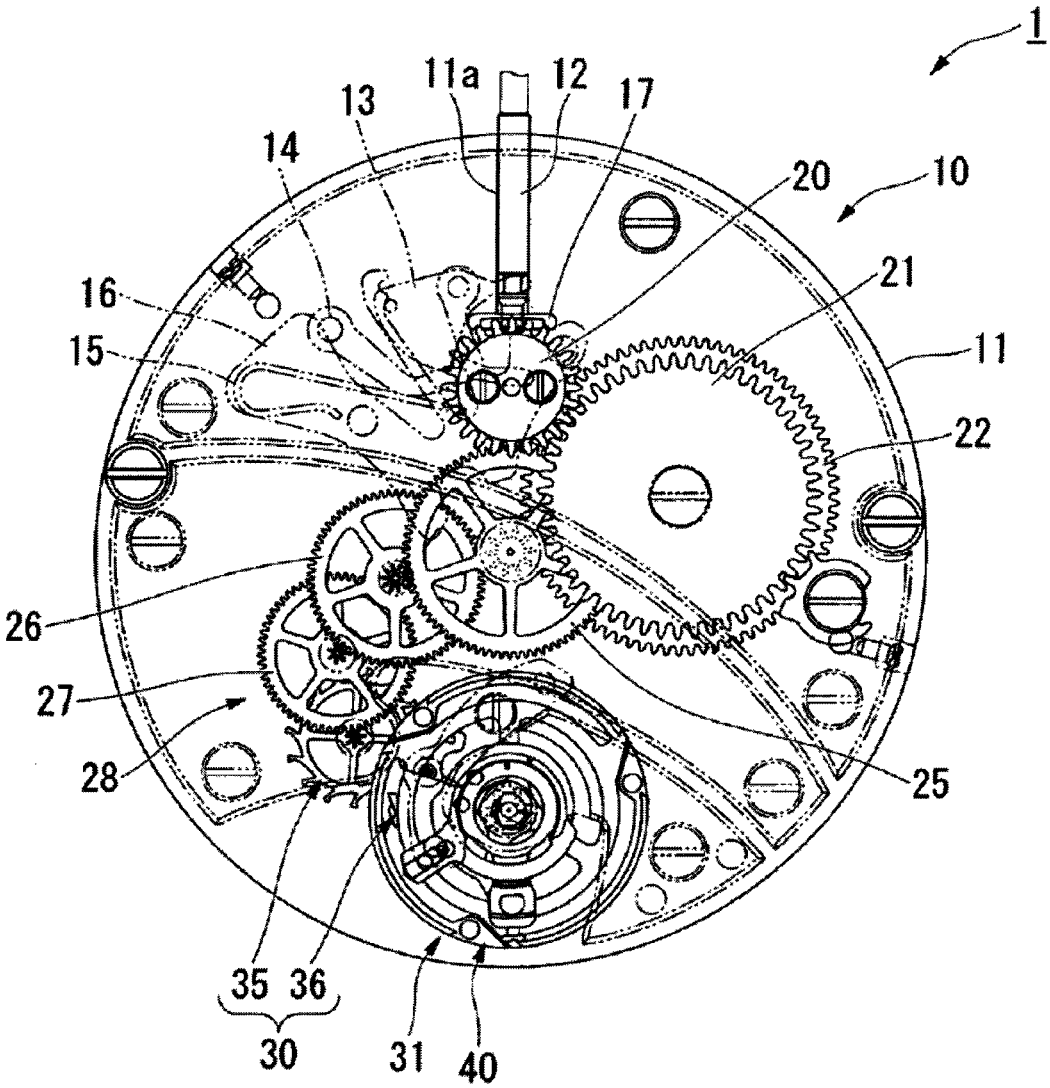
FIG. 1 illustrates an embodiment according to the present invention and is a configuration diagram of a movement of a mechanical timepiece.

As illustrated in FIG. 1, a mechanical timepiece 1 according to the present embodiment is a watch or the like, and is configured to include a movement (timepiece movement) 10 and a casing (not illustrated) which accommodates the movement 10.

(Configuration of Movement)

The movement 10 has a main plate 11 configuring a substrate. A dial (not illustrated) is arranged on a rear side of the main plate 11. A train wheel incorporated on a front side of the movement 10 is referred to as a front train wheel 28 and a train wheel incorporated on a rear side of the movement 10 is referred to as a rear train wheel.

A winding stem guide hole 11*a* is formed in the main plate 11 and a winding stem 12 is rotatably incorporated therein. The winding stem 12 has an axially determined position by a switching device having a setting lever 13, a yoke 14, a yoke spring 15 and a setting lever jumper 16. In addition, a winding pinion 17 is rotatably disposed in a guide axle of the winding stem 12.

In such a configuration, for example, if the winding stem 12 is rotated in a state where the winding stem 12 is located in a first winding stem position (zero stage) closest to an inner side of the movement 10 along a rotational axle direction, the winding pinion 17 is rotated via the rotation of a clutch wheel (not illustrated). Then, if the winding pinion 17 is rotated, a crown wheel 20 meshing therewith is rotated. Then, if the crown wheel 20 is rotated, a ratchet wheel 21 meshing therewith is rotated. Further, if the ratchet wheel 21 is rotated, a main spring (power source; not illustrated) accommodated in a movement barrel 22 is wound up.

The front train wheel 28 of the movement 10 is configured to include not only the movement barrel 22 but also a center wheel & pinion 25, a third wheel & pinion 26 and a second wheel & pinion 27, and fulfills a function of transferring the rotational force of the movement barrel 22. In addition, an escapement mechanism 30 and a speed control mechanism 31 each of which controls the rotation of front train wheel 28 are arranged on the front side of the movement 10.

The center wheel & pinion 25 meshes with the movement barrel 22. The third wheel & pinion 26 meshes with the center wheel & pinion 25. The second wheel & pinion 27 meshes with the third wheel & pinion 26.

The escapement mechanism 30 is a mechanism controlling the rotation of the above-described front train wheel 28 and includes an escape wheel 35 meshing with the second wheel & pinion 27 and includes a pallet fork 36 causing the escape wheel 35 to escape so as to be regularly rotated.

The speed control mechanism 31 is a mechanism controlling a speed of the escapement mechanism 30 and includes a balance (temperature compensation-type balance) 40.

(Configuration of Balance)

Figure 2:
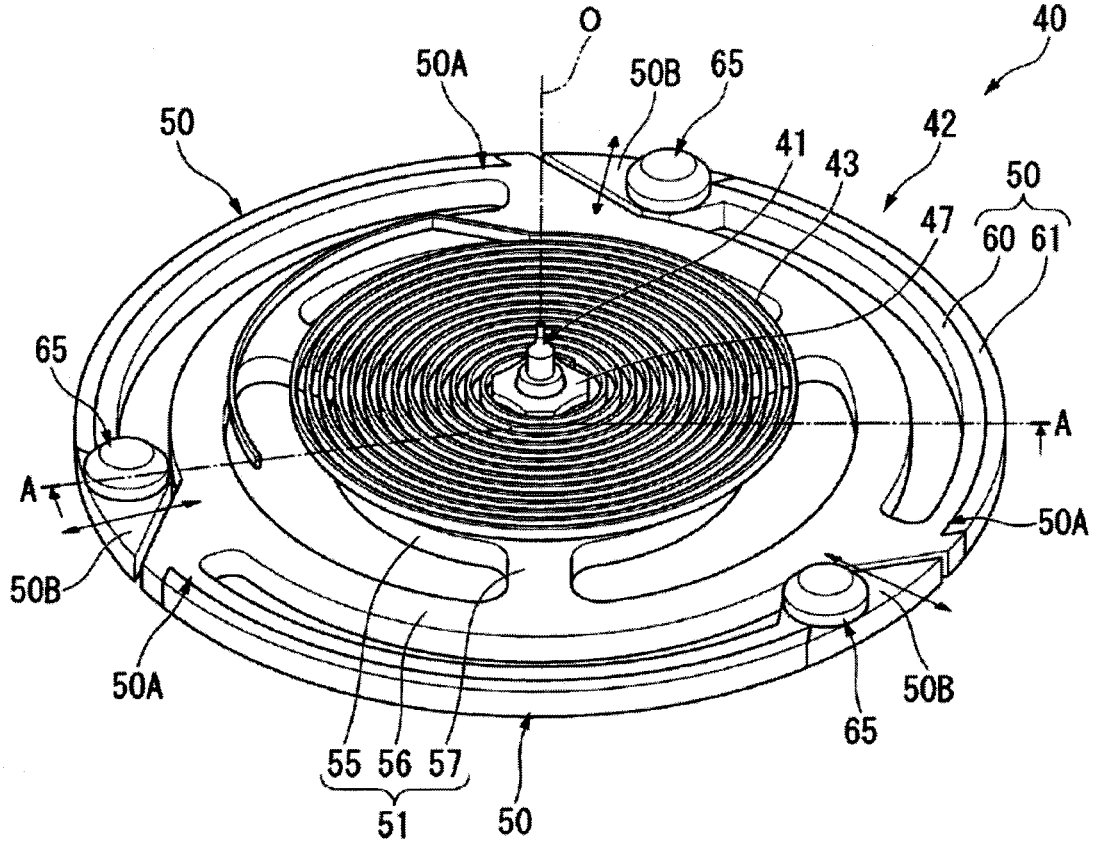
FIG. 2 is a perspective view of a balance (temperature compensation-type balance) configuring the movement illustrated in FIG. 1.
Figure 3:
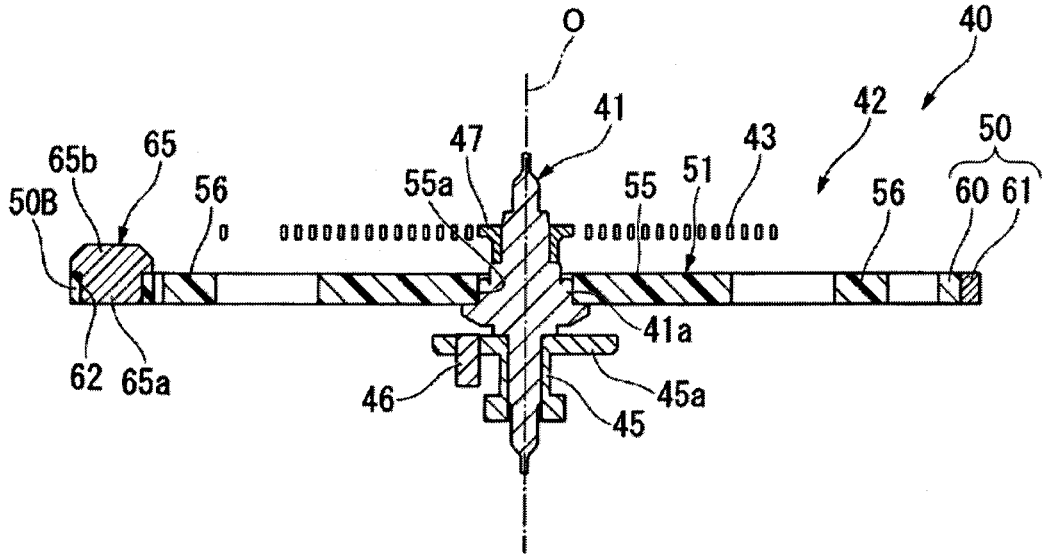
FIG. 3 is a cross-sectional view taken along the line A-A illustrated in FIG. 2.

As illustrated in FIGS. 2 and 3, the balance 40 includes a balance staff 41 rotating (pivotally rotates) about an axial rotation axis (rotational axle) O, a balance wheel 42 attached to the balance staff 41 and a hairspring (balance spring) 43. The balance 40 is a member rotating forward and backward around the axial line O at a constant oscillation cycle by the power transferred from the hairspring 43.

In the embodiment, a direction orthogonal to the axial line O is referred to as a radial direction and a direction revolving around the axial line O is referred to as a circumferential direction.

The balance staff 41 is an axle body which vertically extends along the axial line O, and an upper end portion and a lower end portion are pivotally supported by a member such as a main plate or a balance bridge (all not illustrated) configuring the movement 10. A substantially intermediate portion of the balance staff 41 in the vertical direction is a large diameter portion 41*a* having the largest diameter. In addition, in the balance staff 41, a cylindrical double roller 45 is mounted externally and coaxially with the axial line O on a portion positioned below the large diameter portion 41*a*. The double roller 45 has an annular rim portion 45*a* protruding radially outward, and an impulse pin 46 for oscillating the pallet fork 36 is fixed to the rim portion 45*a*.

For example, the hairspring 43 is a flat hairspring which is wound in a spiral shape inside one plane, and an inner end portion thereof is fixed to a portion positioned above the large diameter portion 41*a* in the balance staff 41 via a collet 47. Then, the hairspring 43 plays a role of storing the power transferred from the second wheel & pinion 27 to the escape wheel 35 and transferring the power to the balance wheel 42 as described above.

The hairspring 43 of the embodiment is formed of an ordinary steel material having a temperature coefficient with the negative Young's modulus and has a characteristic in which a spring constant is lowered by a temperature rise.

Figure 4:
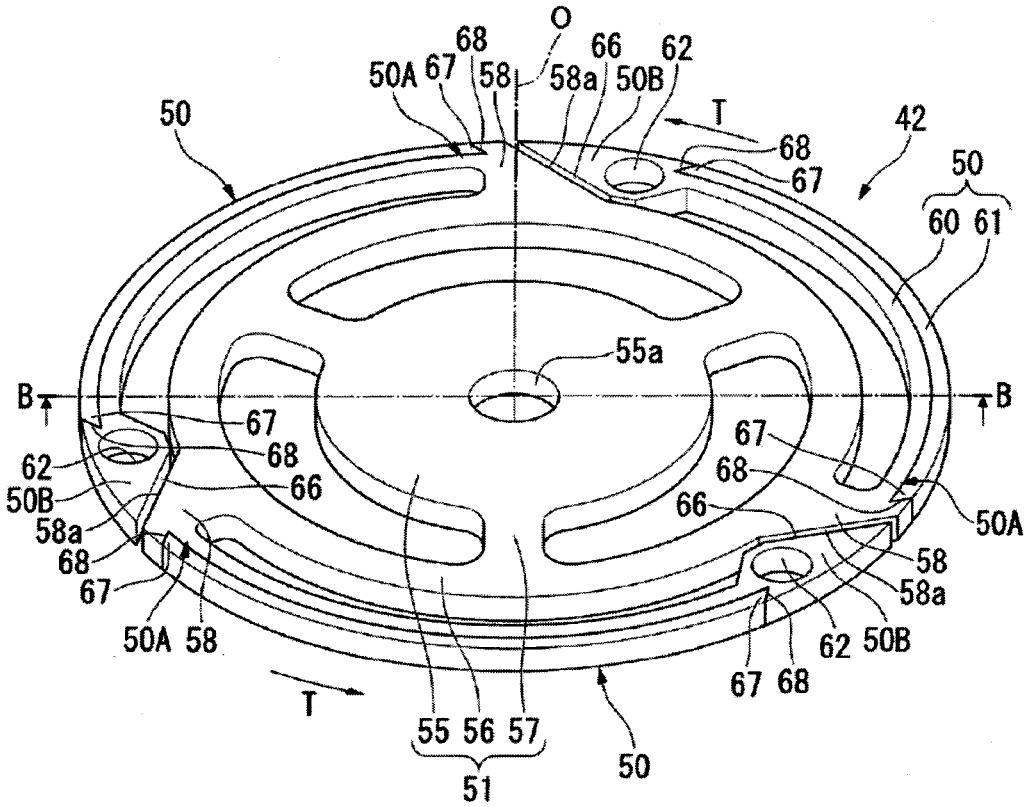
FIG. 4 is a perspective view of a balance wheel configuring the balance illustrated in FIG. 2.
Figure 5:
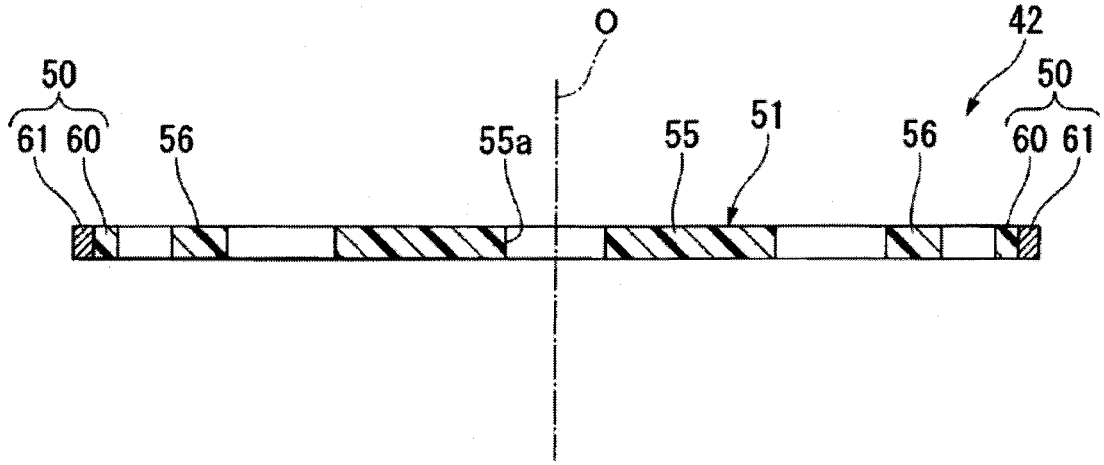
FIG. 5 is a cross-sectional view taken along the line B-B illustrated in FIG. 4.

As illustrated in FIGS. 4 and 5, the balance wheel 42 includes three bimetal portions 50 which are disposed around the axial line O of the balance staff 41 along the circumferential direction and connection member 51 which respectively and radially connects these three bimetal portions 50 and the balance staff 41.

The connection member 51 is arranged coaxially with the axial line O and includes a circular connection plate 55 which has an axle hole 55*a* formed at the center thereof, a connection ring 56 which surrounds the circular connection plate 55 by being spaced with an interval from the outside in the radial direction and three connection bridges 57 which connect an outer periphery portion of the circular connection plate 55 and an inner periphery portion of the connection ring 56.

Then, the connection member 51 is fixed to the large diameter portion 41*a* of the balance staff 41 via the axle hole 55*a* by press-fitting for example, thereby being attached to be integrated with respect to the balance staff 41.

An outer periphery portion of the connection ring 56 has three support protrusions 58 which protrude radially outward. These three support protrusions 58 are uniformly disposed by being spaced with a constant interval in the circumferential direction. In addition, in each of the support protrusions 58, a tilting (inclined) surface 58*a* is formed which is gradually tilted (inclined) toward one side (arrow T direction illustrated in FIG. 4) in the circumferential direction as being radially outward from the outer periphery portion of the connection ring 56.

The connection bridge 57 is a member which radially connects the circular connection plate 55 and the connection ring 56 and the connecting bridges 57 are uniformly disposed by being spaced with a constant interval along the circumferential direction. In the illustrated example, three of the connection bridges 57 and three of the support protrusions 58 are arranged in a state of mutually misaligned in the circumferential direction. However, the arrangement is not limited to this case.

The bimetal portion 50 is a layered body in which a first member 60 positioned radially inward and a second member 61 positioned radially outward the first member 60 are mutually and radially overlapped to be bonded to each other. The bimetal portion 50 is formed in a belt shape extending in an arc shape along the circumferential direction. Then, the bimetal portion 50 is disposed in a state where the connection ring 56 is provided with an interval radially outward and arranged along the circumferential direction, and one end portion in the circumferential direction is a fixed end 50A connected to the connection member 51.

Specifically, the fixed end 50A of the bimetal portion 50 is connected to an opposite surface of the tilting surface 58*a* in the circumferential direction in the support protrusion 58 protruding from the connection ring 56. Then, the bimetal portion 50 extends from the support protrusion 58 toward the arrow T direction along the circumferential direction. In this manner, three of the bimetal portions 50 are uniformly disposed in the circumferential direction.

In addition, the other end portion of the bimetal portion 50 in the circumferential direction is a free end 50B which is radially movable due to a bending deformation caused by the temperature change. The free end 50B is mainly formed of the first member 60 and formed to be radially wider than other portions of the bimetal portion 50 by protruding radially inward.

In this manner, the weight of the free end 50B is designed to be heavier than other portions in the bimetal portion 50. Besides, a weight hole 62 is formed in the free end 50B of the embodiment, and a weight portion 65 (refer to FIGS. 2 and 3) is attached in the weight hole 62 by the press-fitting for example. Therefore, the free end 50B is designed to be sufficiently heavier than other portions in the bimetal portion 50 in that the weight of the weight portion 65 is applied thereto.

As illustrated in FIGS. 2 and 3, the weight portion 65 is exemplified in a case where an axle portion 65*a* which is inserted into the weight hole 62 and a head portion 65*b* which is exposed on an upper surface of the free end 50B are formed to be a rivet.

In addition, as illustrated in FIG. 4, a portion of the free end 50B facing radially inward opposes the tilting surface 58*a* of the support protrusion 58, thereby being an opposed tilting surface 66 which is tilted along with a tilt of the tilting surface 58*a*.

Incidentally, as illustrated in FIGS. 4 and 5, the above-described bimetal portion 50 is formed by radially overlapping the first member 60 and the second member 61 to be layered, and these members are formed of a material having a thermal expansion coefficient different from each other.

Specifically, the first member 60 positioned radially inward is formed of a ceramic material which is a low thermal expansion material, and silicon (Si) is used in the embodiment. Meanwhile, the second member 61 positioned radially outward is a high thermal expansion material of which the thermal expansion coefficient is higher than that of the first member 60 and is formed of a metal material allowing the electrocasting, and gold (Au) is used in the embodiment.

Therefore, when the temperature rises, the second member 61 is thermally expanded more than the first member 60, and thus, the bimetal portion 50 is bent and deformed so as to cause the free end 50B to move radially inward with the fixed end 50A as its starting point.

In addition, the first member 60 of the embodiment is formed to be integrated with the connection member 51. Therefore, similar to the first member 60, the connection member 51 is also formed of the silicon. That is, in the balance wheel 42 configuring the balance 40, the connection member 51 and the first member 60 are formed of the silicon, and only the second member 61 is formed of the gold.

Besides, this second member 61 is an electrocast formed by electrocasting and is closely bonded to the first member 60 during a spreading process of the gold through the electrocasting. Additionally, at both end portions of the second member 61 in the circumferential direction, a V-shaped wedge portion (second engagement portion) 67 in a plan view is formed which gradually extends in the circumferential direction as being radially inward so as to be bonded to a V-shaped concave portion (first engagement portion) 68 in a plan view which is formed on the first member 60 side in a state of engaging therewith.

In this manner, the second member 61 is bonded to be in a positioned state with respect to the first member 60 in the circumferential direction.

[Temperature Correction Method]

Next, a temperature correction method for the moment of inertia using the balance 40 will be described.

According to the balance 40 of the embodiment, as illustrated in FIG. 2, if the temperature is changed, the bimetal portion 50 is radially bent and deformed with the fixed end 50A as its starting point due to a difference in the thermal expansion coefficient between the first member 60 and the second member 61, thereby enabling the free end 50B of the bimetal portion 50 to move radially inward or outward. That is, when the temperature rises, the bimetal portion 50 is bent and deformed radially inward, thereby enabling the free end 50B to move radially inward. When the temperature drops, the free end 50B is enabled to move radially outward on the contrary.

Therefore, it is possible to radially reduce or enlarge an average diameter of the balance wheel 42, and thus, it is possible to change the moment of inertial for the overall balance 40 by changing a distance from the axial line O of the balance staff 41. That is, when the temperature rises, the average diameter of the balance wheel 42 is radially reduced so as to enable the moment of inertia to be decreased. When the temperature drops, the average diameter of the balance wheel 42 is radially enlarged so as to enable the moment of inertia to be increased. In this manner, it is possible to change a slope of temperature characteristics of the moment of inertia to a negative slope. Therefore, it is possible to perform the temperature correction.

That is, even if there is provided with the hairspring 43 of which the Young's modulus has the negative temperature coefficient, at the time of the temperature rise, the moment of inertia can be reduced simultaneously with a decrease of the Young's modulus of the hairspring 43, and thus, it is possible to constantly maintain the oscillation cycle of the balance 40. Therefore, it is possible to perform the temperature correction. In addition, at the time of a temperature drop, the moment of inertia can be increased simultaneously with an increase of the Young's modulus of the hairspring 43, and thus, it is still possible to constantly maintain the oscillation cycle of the balance 40. Therefore, it is possible to perform the temperature correction.

Figure 33:
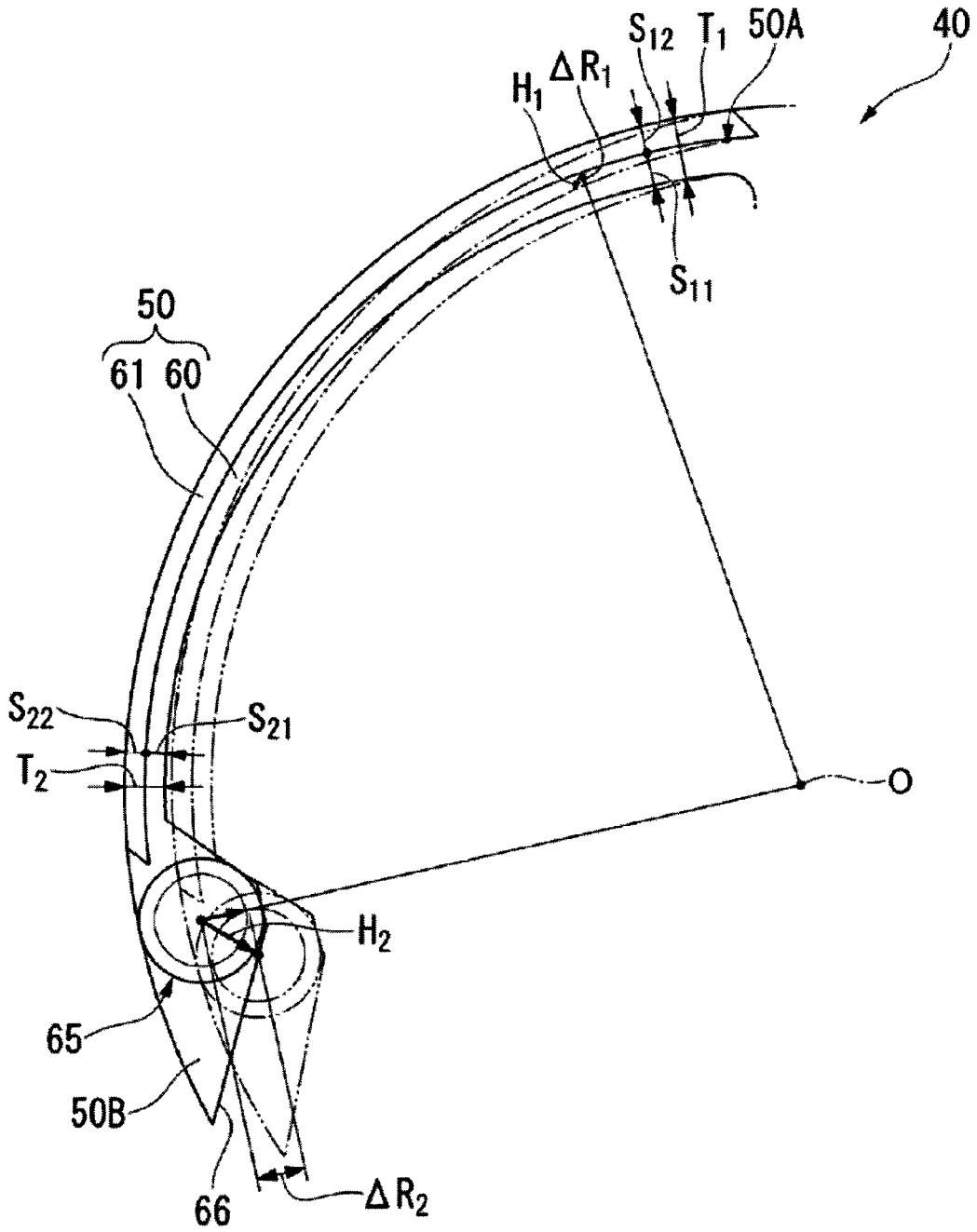
FIG. 33 is an enlarged plan view of a bimetal portion.

Here, additional characteristics of the temperature correction method will be described in FIGS. 33 and 34. As illustrated in FIG. 33, in the bimetal portion 50 according to the embodiment, a thickness $T_1$ of a portion positioned at the fixed end 50A side along the radial direction is thick compared to a thickness $T_2$ of a portion positioned at the free end 50B side, and the bimetal portion 50 becomes gradually thinner as being from the fixed end 50A side toward the free end 50B side in its entirety.

In the embodiment, each thickness of the first member 60 and the second member 61 which are described above becomes gradually thinner as being from the fixed end 50A side toward the free end 50B side. In the illustrated example, in the first member 60, a thickness of the portion positioned at the fixed end 50A side is $S_{11}$ and a thickness of the portion positioned at the free end 50B side is $S_{21}$ ($S_{11}>S_{21}$). In addition, in the second member 61, a thickness of the portion positioned at the fixed end 50A side is $S_{12}$ and a thickness of the portion positioned at the free end 50B side is $S_{22}$ ($S_{12}>S_{22}$).

In addition, in the bimetal portion 50, a thickness ratio of the first member 60 to the second member 61 at the same position along the circumferential direction is uniformly set throughout the overall bimetal portion 50 in the circumferential direction. In this case, for example, a thickness ratio ($S_{11}$ to $S_{12}$) on the fixed end 50A side and a thickness ratio ($S_{21}$ to $S_{22}$) on the free end 50B side are set to be equal to each other (refer to following Equation (2)).

[Equation 2]

$$\frac{S_{11}}{S_{12}} = \frac{S_{21}}{S_{22}} \tag{2}$$

If the Young's modulus of the first member 60 is $E_1$, and the Young's modulus of the second member 61 is $E_2$, it is preferable that the thickness ratio of the thickness $S_1$ (for example, $S_{11}$, $S_{12}$) of the first member 60 to the thickness $S_2$ (for example, $S_{21}$, $S_{22}$) of the second member 61 at the same position along the circumferential direction in the bimetal portion 50 be set to fulfill the following Equation (3). In this manner, the deformation volume toward the radial direction at an arbitrary position of the bimetal portion 50 along the circumferential direction can be increased.

[Equation 3]

$$\frac{S_1}{S_2} = \sqrt{\frac{E_2}{E_1}} \tag{3}$$

Figure 34:
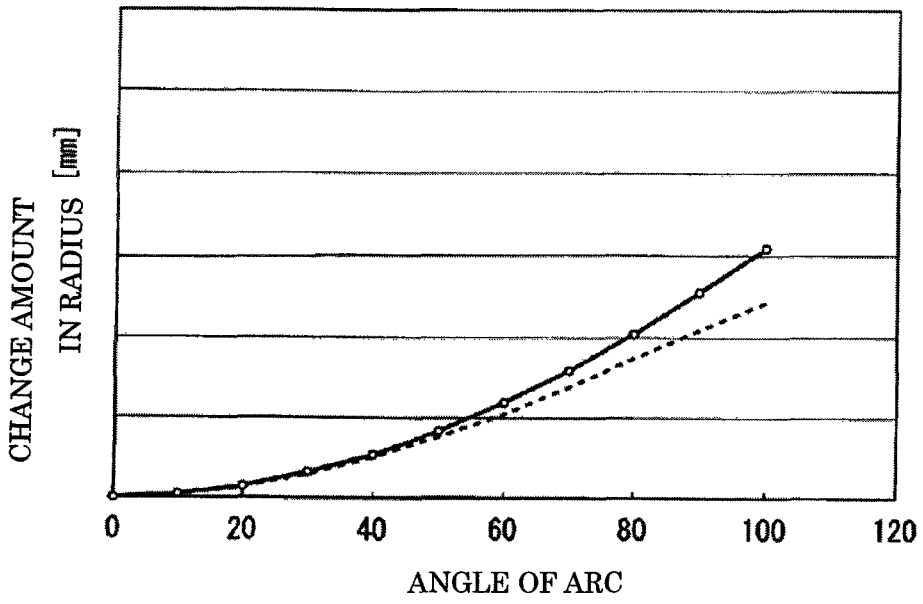
FIG. 34 is a graph showing a change amount in radius AR (mm) with respect to an arc degree 0 (deg) in the bimetal portion.

FIG. 34 is a graph showing a change amount in radius AR (mm) with respect to an arc degree θ (deg) in the bimetal portion 50.

Figure 6:
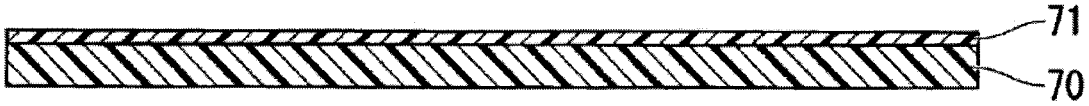
FIG. 6 is a process view at the time of manufacturing the balance wheel illustrated in FIG. 4, and is a cross-sectional view illustrating a state where a silicon oxide film is formed on a silicon substrate.

In a central angle around axial line O, the arc degree θ having a straight line as a reference line (0 (deg)) connecting the fixed end 50A and the axial line O in the bimetal portion 50 is an angle formed by an arc from the reference line to an arbitrary position of the bimetal portion 50 along the circumferential direction. In addition, as illustrated in FIG. 6, in an arbitrary position of the bimetal portion 50 along the circumferential direction, the change amount in radius AR is a radial component toward the axial line O out of change vectors (for example, $H_1$, $H_2$) which are from an initial position (solid line in drawing) toward a changed position (chained line in drawing). In the graph shown in FIG. 28, the above-described bimetal portion 50 of the embodiment is shown in a solid line, and the bimetal portion 50 extending from the fixed end 50A to the free end 50B at the same thickness as the fixed end 50A (for example, $T_1$) of the embodiment is shown in a dotted line as a comparative example.

Here, as illustrated in FIGS. 33 and 34, according to the embodiment, since the thickness of the bimetal portion 50 becomes gradually thinner as being from the fixed end 50A side toward the free end 50B side so as to be likely bent and deformed as being from the fixed end 50A side toward the free end 50B side. Specifically, at the time of the temperature rise, the bimetal portion 50 deforms so as to be tilted radially inward as being toward the free end 50B side. Therefore, a change amount in radius $\Delta R_2$ on the free end 50B side (for example, center of the weight portion 65) of the bimetal portion 50 becomes large compared to a change amount in radius $\Delta R_1$ on the fixed end 50A side.

Accordingly, in the bimetal portion 50 of the embodiment, it is understood that the change amount in radius $\Delta R_2$ on the free end 50B side can be increased compared to the comparative example while maintaining the thickness on the fixed end 50A side.

In addition, according to the embodiment, since the change vector $H_2$ of the free end 50B is oriented toward a direction of the axial line O in accordance with the temperature change, in other words, since the bimetal portion 50 deforms so as to be rolled toward the axial line O from a tip end side where the free end 50B is present, it is possible to increase the change amount in radius ΔR compared to a case of being in the uniform thickness. Therefore, it is possible to effectively ensure the change amount in radius $\Delta R_2$ in a limited arc length of the bimetal portion 50.

In this manner, according to the balance 40 of the embodiment, since the bimetal portion 50 becomes gradually thinner from the fixed end 50A side toward the free end 50B side, it is possible to ensure the change amount in radius $\Delta R_2$ on the free end 50B side while ensuring the thickness on the fixed end 50A side. Therefore, it is possible to first ensure the intensity of the bimetal portion 50 and ensure the necessary temperature correction amount of the moment of inertia.

As a result, it is possible to prevent the bimetal portion 50 from being elastically deformed or being damaged due to a shock and stably perform temperature correction work as intended, and thus, it is possible to provide a high quality balance 40 which is unlikely to vary in a rate influenced by the temperature change and excels in temperature compensation performance.

Particularly, in the embodiment, the balance 40 can be made through a semiconductor process such as a photolithography technique by forming the connection member 51 and the first member 60 using the ceramic material such as silicon. In this case, compared to a case of making the connection member 51 or the first member 60 through a mechanical processing, a high-precision balance 40 having a high degree of freedom in the shape can be provided. In addition, since it is possible to form the connection member 51 and the first member 60 more easily and efficiently, it is likely to further enhance manufacturing efficiency.

Then, since at least the first member 60 between the first member 60 and the second member 61 is formed gradually thinner as being from the fixed end 50A side toward the free end 50B side, even in a case of forming the first member 60 using the ceramic material that is a brittle material, it is possible to first ensure the intensity on the fixed end 50A side and ensure the change amount in radius.

Furthermore, since the thickness ratio of the first member 60 and the second member 61 in the radial direction is uniform from the fixed end 50A side to the free end 50B side, a deformation degree of the first member 60 and the second member 61 becomes uniform from the fixed end 50A side to the free end 50B side based on the thermal expansion coefficient and the Young's moduli $E_1$ and $E_2$. That is, it is possible to suppress the deformation degree influenced by a difference of the thickness ratio from being deviated. Thus, it is possible to stably deform the bimetal portion 50, and a length of the bimetal portion 50 along the circumferential direction is likely to be set in accordance with the necessary temperature correction amount of the moment of inertia.

[Manufacturing Method of Balance]

Next, a manufacturing method of the balance 40 will be described with reference to the drawings.

The manufacturing method of the balance 40 includes a step of manufacturing the balance staff 41, a step of manufacturing the balance wheel 42, a step of manufacturing the hairspring 43 and a step of combining the balance staff 41, the balance wheel 42 and the hairspring 43 to be integrated with each other. Here, the step of manufacturing the balance wheel 42 will be mainly described in detail.

First, as illustrated in FIG. 6, after preparing a silicon substrate (ceramic substrate) 70 which becomes the connection members 51 and the first members 60 afterward, a silicon oxide film (SiO2) 71 is formed on a front surface thereof. At this time, the silicon substrate 70 thicker than the balance wheel 42 is employed. In addition, the silicon oxide film 71 is formed by a method such as the plasma chemical vapor deposition method (PCVD) or thermal oxidation for example.

In order to simplify the description here, a case will be described as an example in which only one of the balance wheel 42 is manufactured from the square-shaped silicon substrate 70 in a plan view. However, a plurality of balance wheels 42 may be simultaneously manufactured at a time by preparing a wafer-shaped silicon substrate.

Figure 7:
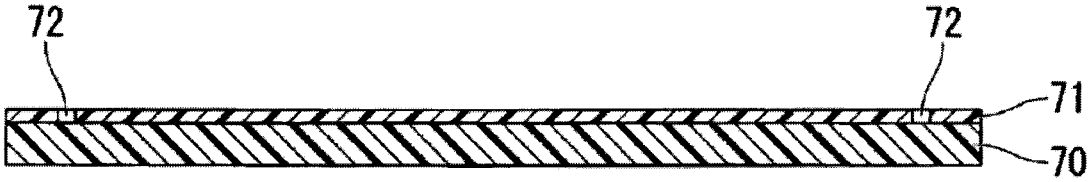
FIG. 7 is a cross-sectional view illustrating a state where an arc-shaped groove portion is formed on the silicon oxide film based on the state illustrated in FIG. 6.
Figure 8:
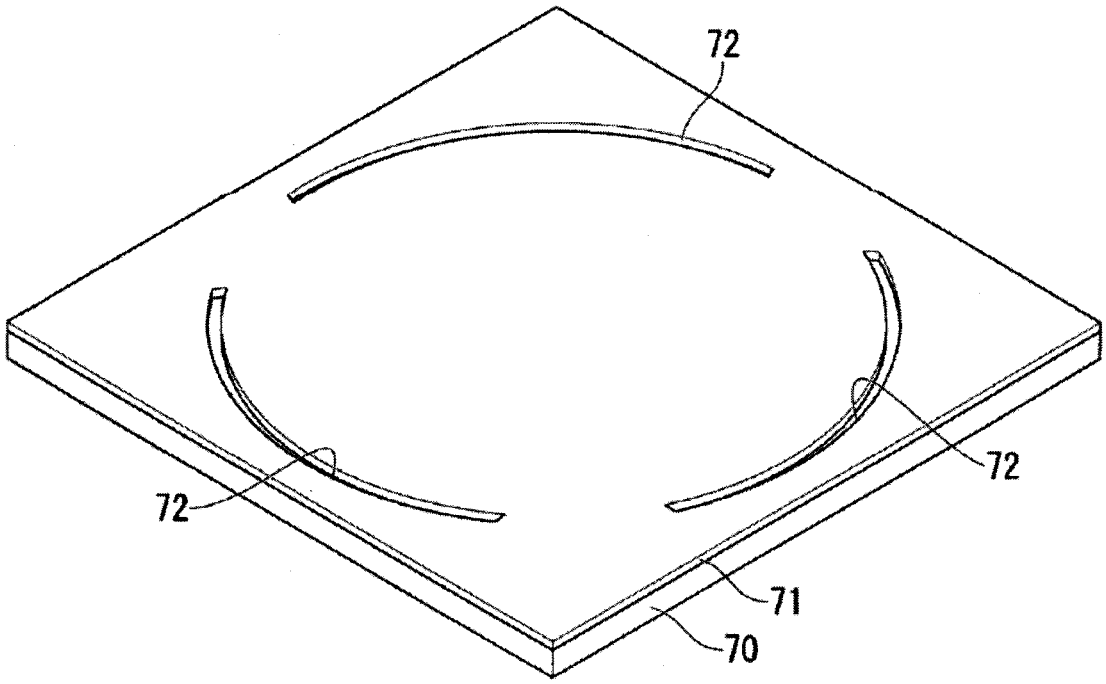
FIG. 8 is a perspective view in a state illustrated in FIG. 7.

Subsequently, as illustrated in FIGS. 7 and 8, a portion of the silicon oxide film 71 is selectively removed by etching, and three of arc-shaped groove portions 72 are formed to be arranged by being spaced with an interval in the circumferential direction. The groove portions 72 are grooves for forming a guide wall 70A for electrocasting which is to be formed afterward and formed to be positioned more radially outward than the second member 61.

Figure 9:
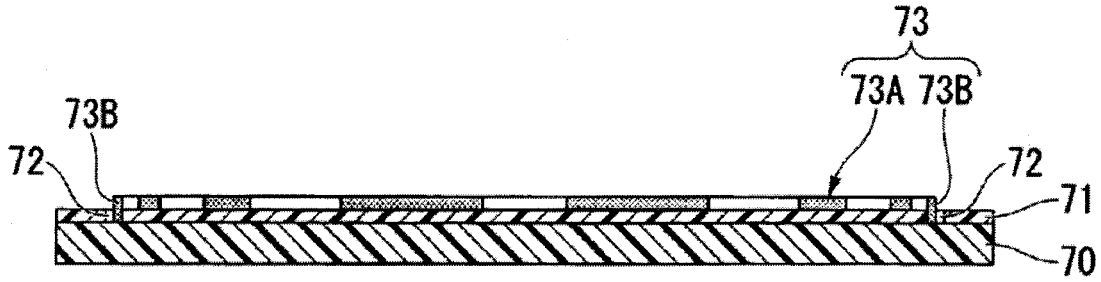
FIG. 9 is a cross-sectional view illustrating a state where a resist pattern is formed on the silicon oxide film based on the state illustrated in FIG. 7.
Figure 10:
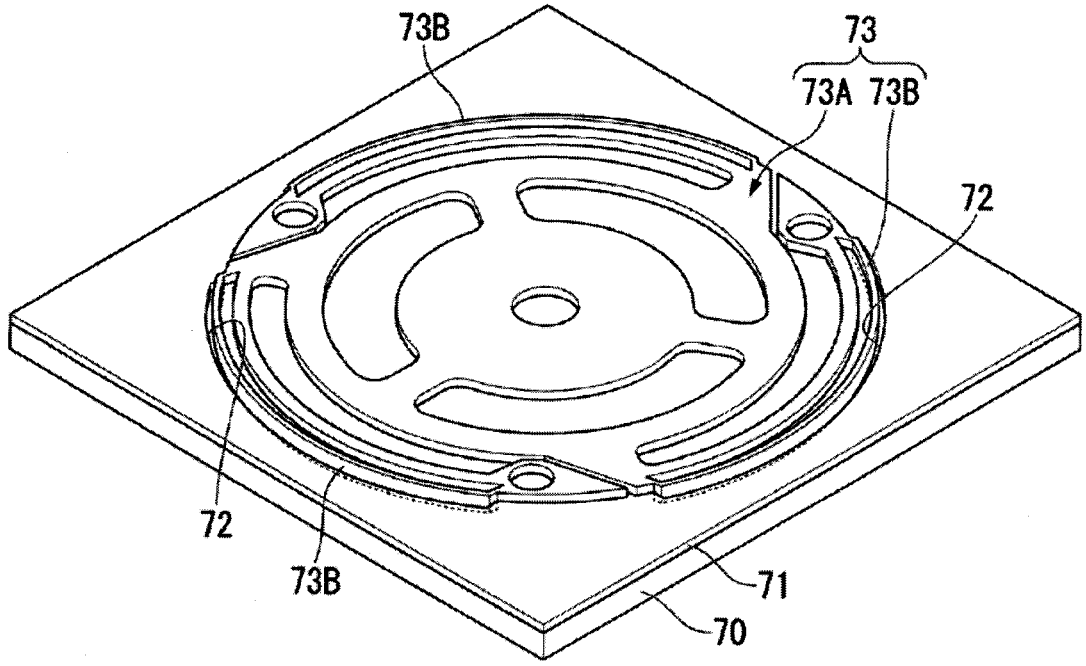
FIG. 10 is a perspective view in a state illustrated in FIG. 9.
Figure 11:
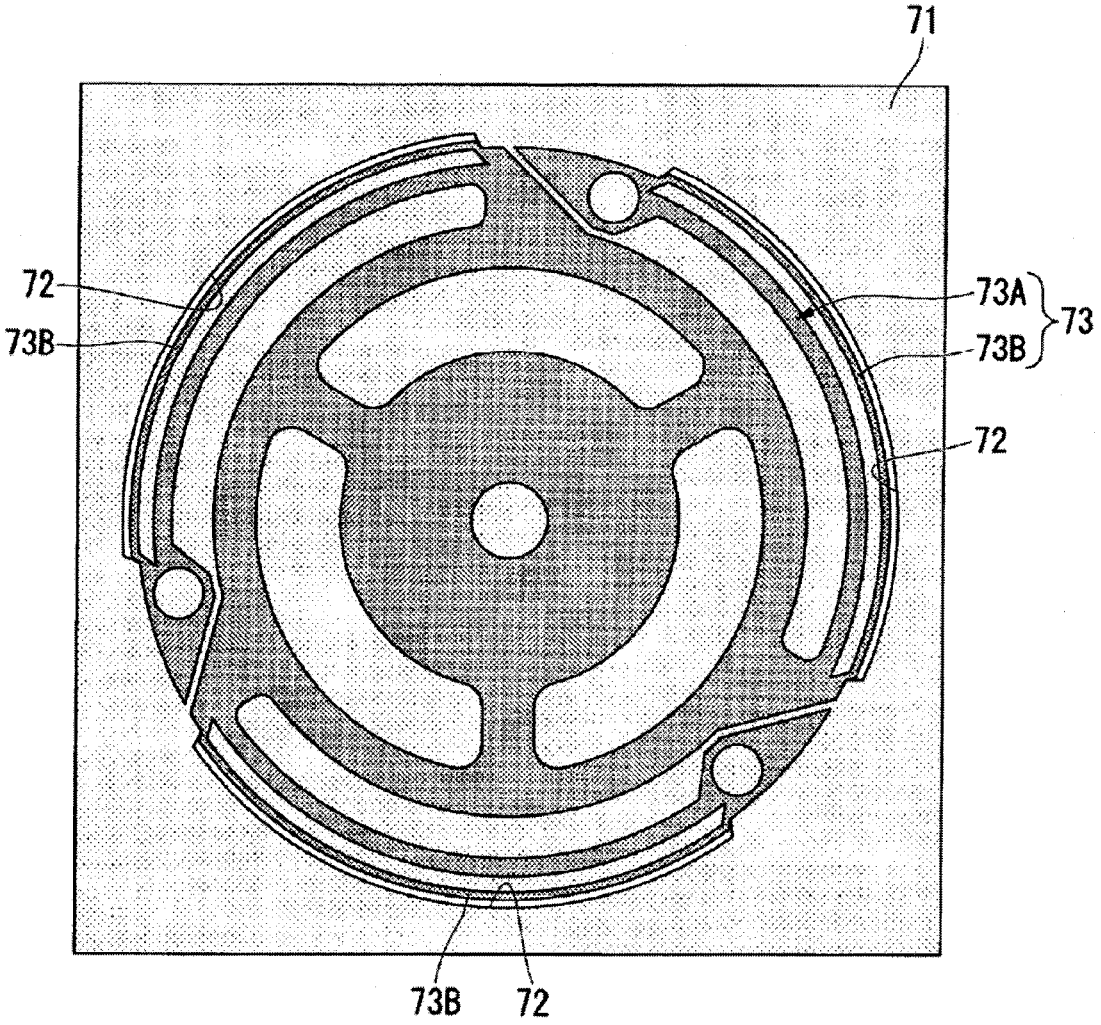
FIG. 11 is a top view in a state illustrated in FIG. 9.

Subsequently, as illustrated in FIGS. 9 to 11, after forming a photo-resist in an inward region surrounded by three of the groove portions 72 on the silicon oxide film 71, the photo-resist is patterned to form resist patterns 73. At this time, the resist pattern 73 is formed to have a configuration including a resist pattern main body 73A which is patterned along the shape of the connection member 51 and the first member 60 and including a pattern 73B for guide wall which is inserted into each of three groove portions 72 and of which both end portions in the circumferential direction are connected to the resist pattern 73.

The photo-resist may be formed through a common method such as spin coating and spray coating. In addition, the resist pattern 73 may be formed by patterning the photo-resist through the common method such as a photolithography technique.

Figure 12:
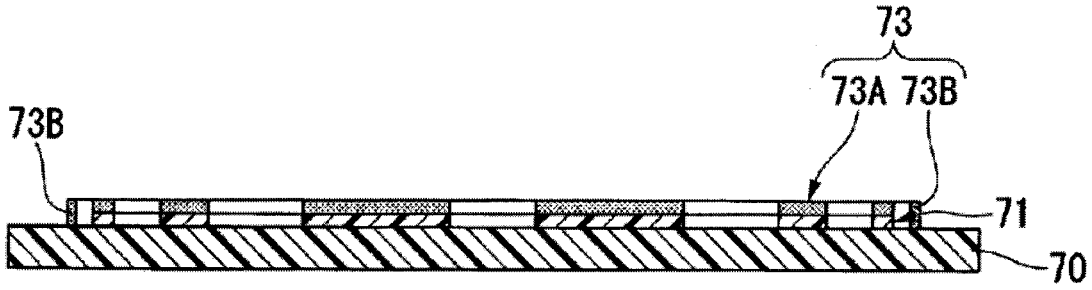
FIG. 12 is a cross-sectional view illustrating a state of having the resist pattern as a mask and having the silicon oxide film to be selectively removed based on the state illustrated in FIG. 9.
Figure 13:
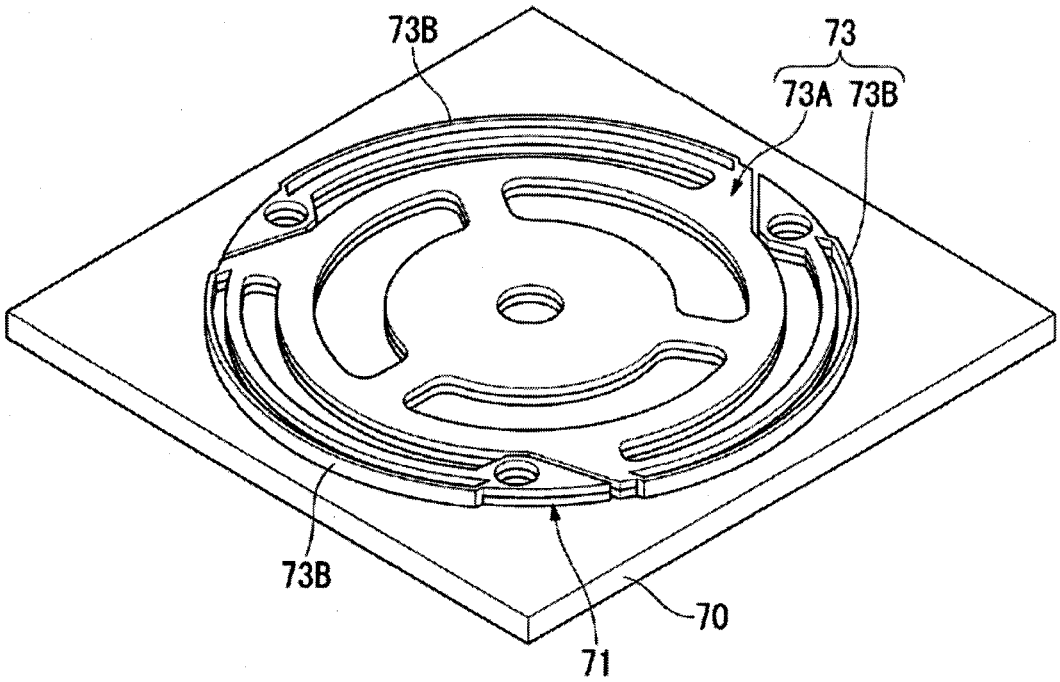
FIG. 13 is a perspective view in a state illustrated in FIG. 12.

Subsequently, as illustrated in FIGS. 12 and 13, in the silicon oxide film 71, a region which is not masked by the resist pattern 73 is selectively removed. Specifically, the silicon oxide film 71 is removed by wet etching employing a buffering aqueous hydrofluoric acid solution or through etching processing by dry etching such as reactive ion etching (RIE).

In this manner, it is possible to leave the silicon oxide film 71 only under the resist pattern 73, thereby enabling the silicon oxide film 71 to be patterned in a shape along the resist pattern 73.

Figure 14:
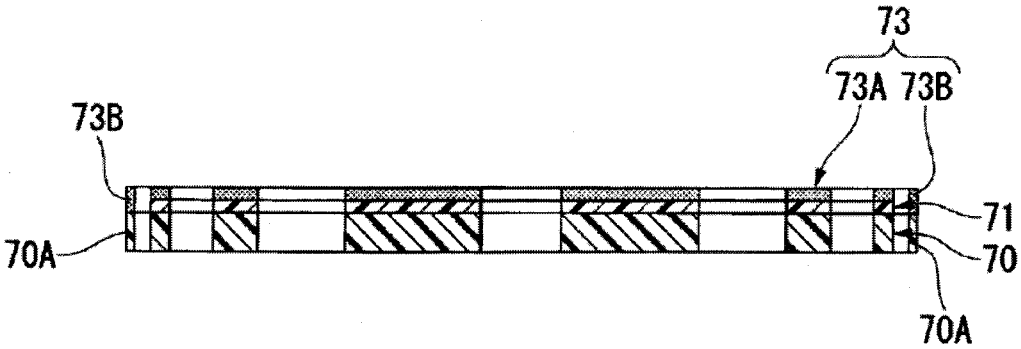
FIG. 14 is a cross-sectional view illustrating a state of having the resist pattern and the silicon oxide film as the mask and selectively removing the silicon substrate based on the state illustrated in FIG. 12.
Figure 15:
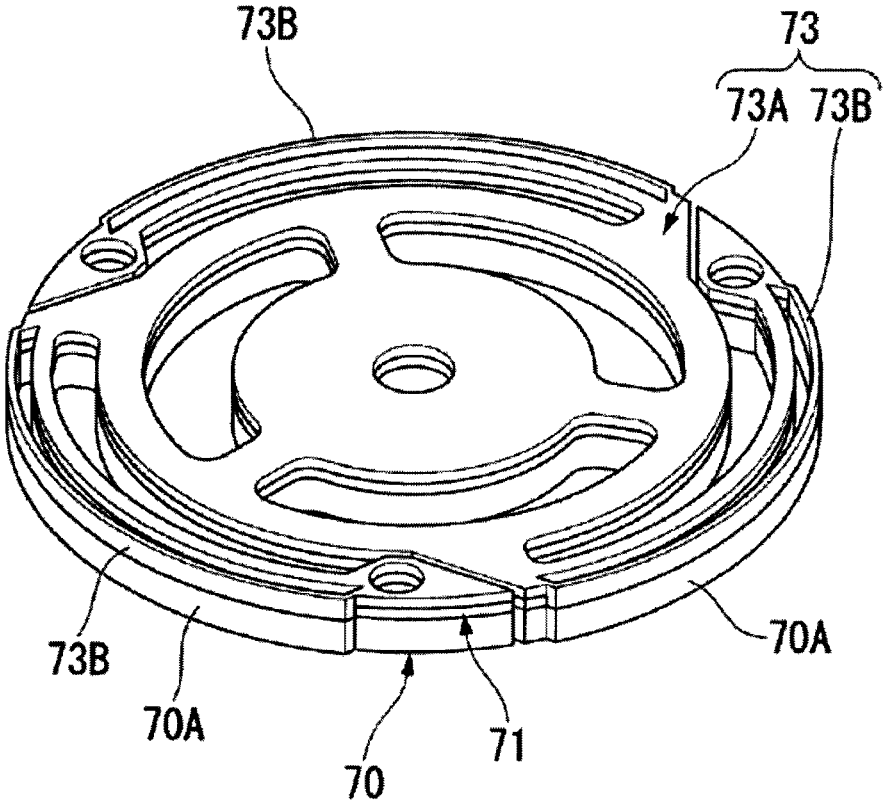
FIG. 15 is a perspective view in a state illustrated in FIG. 14.

Subsequently, as illustrated in FIGS. 14 and 15, in the silicon substrate 70, the region which is not masked by the resist pattern 73 and the silicon oxide film 71 is selectively removed. Specifically, the silicon substrate 70 is removed through etching processing by dry etching such as deep reactive ion etching (DRIE).

In this manner, it is possible to leave the silicon substrate 70 only under the resist pattern 73 and the silicon oxide film 71, thereby enabling the silicon substrate 70 to be patterned in a shape along the resist pattern 73.

Particularly, in the patterned silicon substrate 70, the portion remaining under the pattern 73B for guide wall functions as the guide wall 70A for electrocasting.

Figure 16:
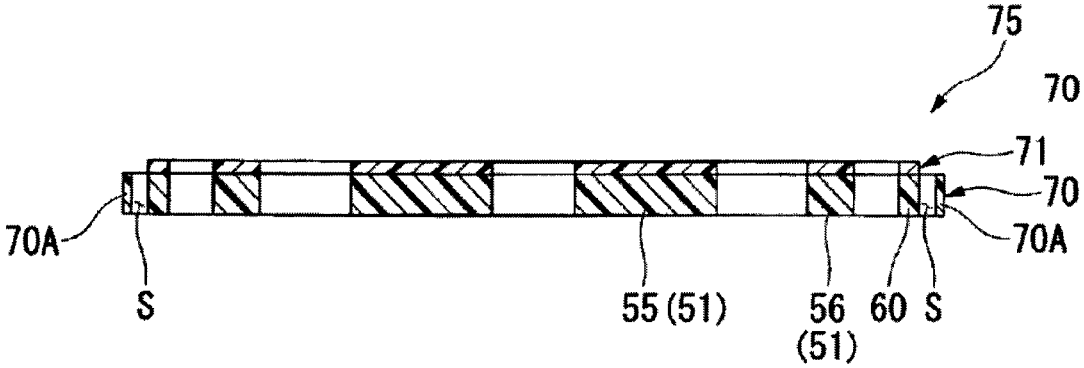
FIG. 16 is a cross-sectional view illustrating a state where the resist pattern is removed and a precursor is formed based on the state illustrated in FIG. 14.
Figure 17:
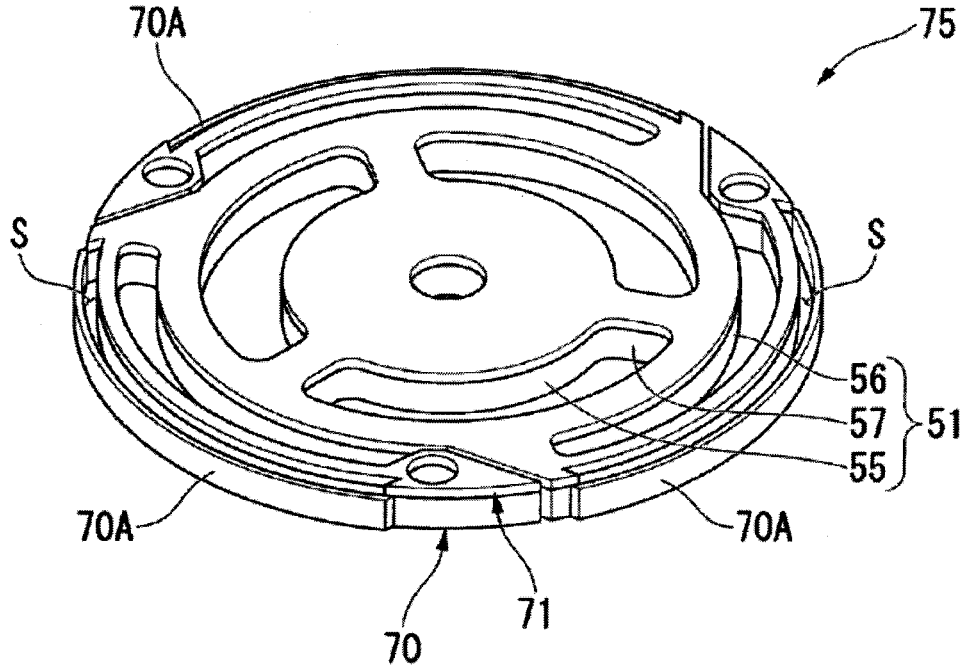
FIG. 17 is a perspective view in a state illustrated in FIG. 16.

Subsequently, as illustrated in FIGS. 16 and 17, the resist pattern 73 which is used as the mask is removed. As a removing method thereof, for example, dry etching by a fuming nitric acid and dry etching employing oxygen plasma can be exemplified.

According to the above-described steps, the silicon substrate 70 is processed by the semiconductor technology so that three of the first members 60 are connected to the connection member 51 to be integrated therewith, and the precursor 75 can be obtained in which the guide wall 70A for electrocasting which defines an open space S for electrocasting between itself and each of the first members 60 is connected to each of the first members 60 to be integrated therewith (Accordingly, each of the above-described steps configures the processing step for the substrate of the invention).

After forming the precursor 75, the second member 61 is formed by spreading the gold in the open space S for electrocasting by the electrocasting, and the step of electrocasting is performed to form the bimetal portion 50 in which the first member 60 and the second member 61 are bonded to each other. The step of electrocasting will be specifically described.

Figure 18:
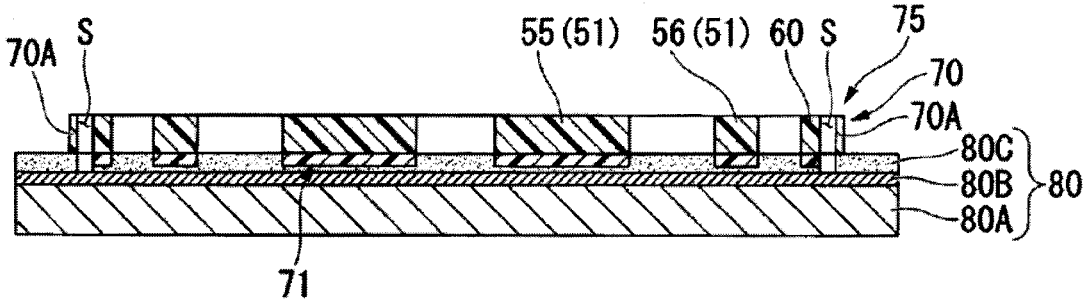
FIG. 18 is a cross-sectional view illustrating a state where after the precursor illustrated
Figure 19:
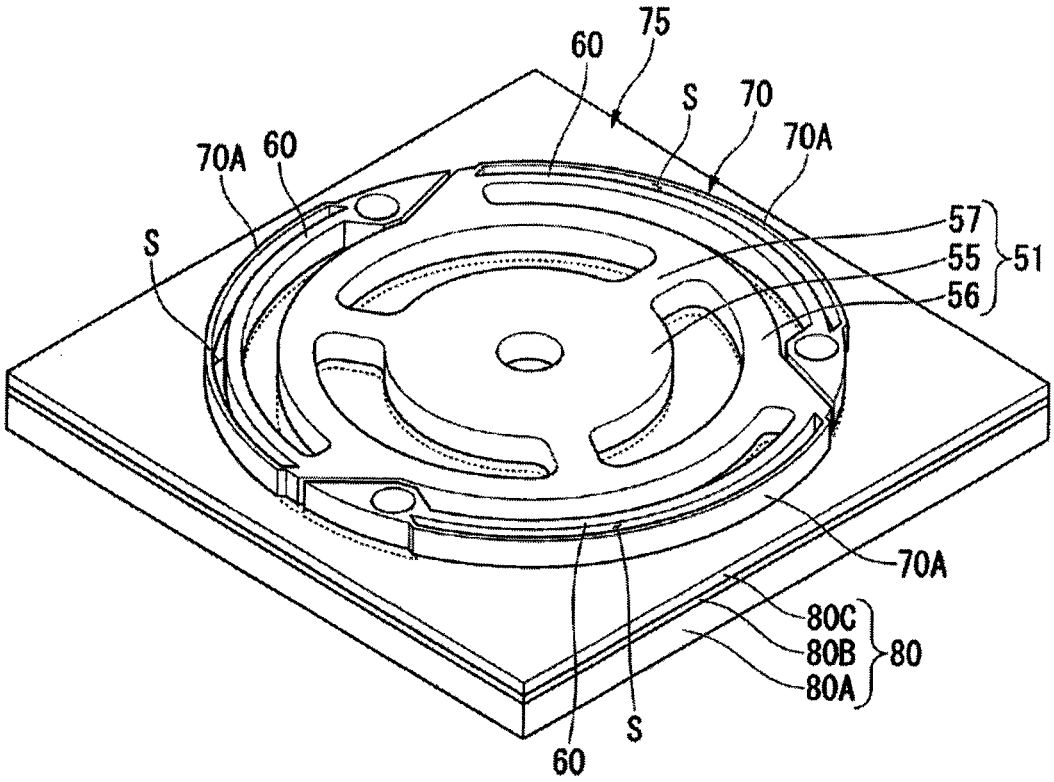
FIG. 19 is a perspective view in a state illustrated in FIG. 18.

First, as illustrated in FIGS. 18 and 19, after preparing a first support substrate 80 to which an adhesion layer 80C is pasted for example, via an electrode layer 80B on a substrate main body 80A, the precursor 75 is turned upside down to cause the patterned silicon oxide film 71 to be laminated on the adhesion layer 80C. In the illustrated example, the precursor 75 and the first support substrate 80 are pasted together to such an extent that the silicon oxide film 71 is embedded inside the adhesion layer 80C.

There is no particular limitation for the adhesion layer 80C. However, it is preferable to employ the photo-resist for example. In this case, the photo-resist is pasted in a paste-like state, and then, the photo-resist may be cured until the photo-resist is no longer in the paste-like state.

Then, after pasting is performed, as illustrated in FIG. 18, in the adhesion layer 80C, portions which communicate with the open space S for electrocasting of the precursor 75 are selectively removed. In this manner, it is possible to expose the electrode layer 80B inside the open space S for electrocasting.

At this time, for example, when the adhesion layer 80C is the photo-resist, it is possible to easily perform the work of a selective removal through the photolithography technique.

Figure 20:
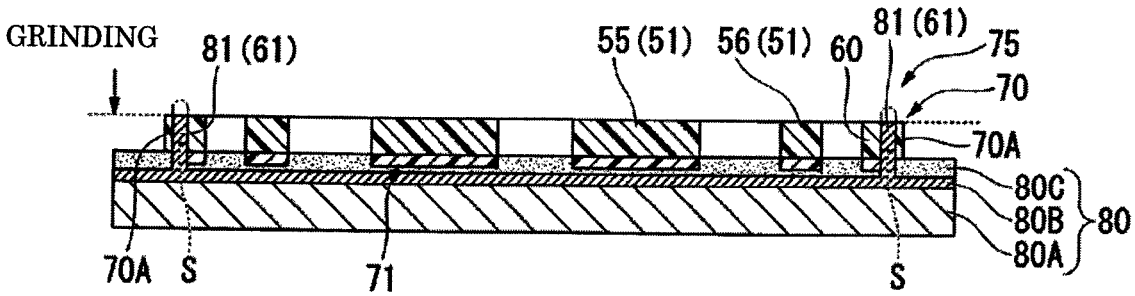
FIG. 20 is a cross-sectional view illustrating a state of spreading gold in an open space for electrocasting of the precursor through electrocasting and forming a second member based on the state illustrated in FIG. 18.
Figure 21:
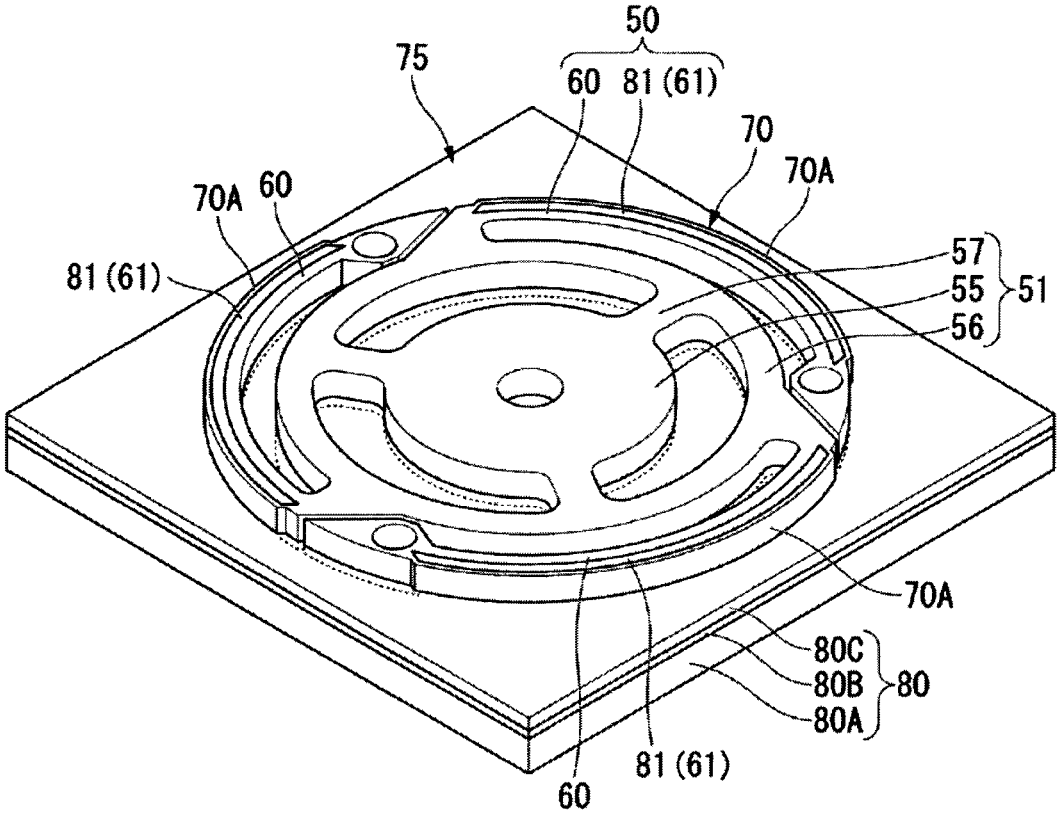
FIG. 21 is a perspective view in a state illustrated in FIG. 20.

Subsequently, as illustrated in FIGS. 20 and 21, the electrocasting is performed using the electrode layer 80B, the gold is gradually spread from the electrode layer 80B in the open space S for electrocasting, the inside of the open space S for electrocasting is fulfilled, and then, an electrocast 81 is generated to the extent that the open space S for electrocasting bulges. Then, this bulging electrocast 81 is grinded so as to be in one surface with the precursor 75. This enables the electrocast 81 to be the second member 61, and thus, it is possible to form the bimetal portion 50 in which the first member 60 and the second member 61 are bonded to each other.

When performing the grinding, the silicon substrate 70 of the precursor 75 may be grinded at the same time.

At this stage, the step of electrocasting ends. In the FIGS. 20 and 21, illustration of general configuration members (electrocasting tank and the like) necessary for the electrocasting is omitted.

After the electrocasting ends, the step of removing is performed to remove the guide wall 70A for electrocasting from the first member 60.

The step of removing will be specifically described.

Figure 22:
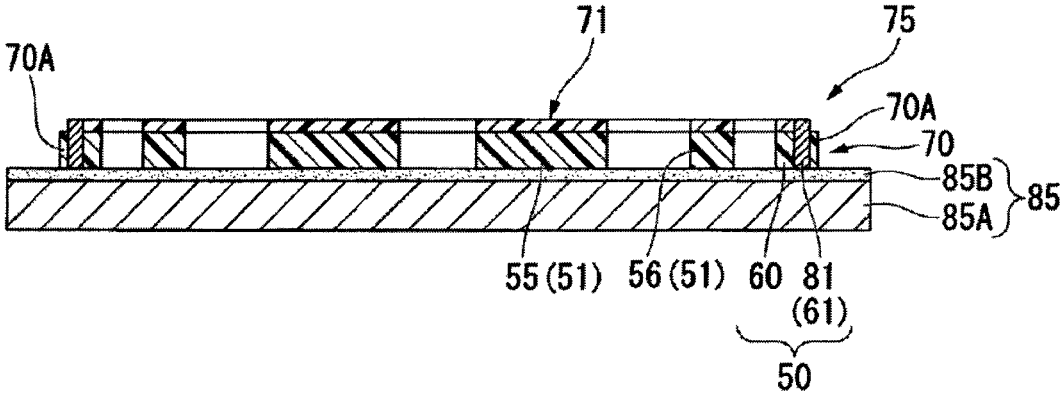
FIG. 22 is a cross-sectional view illustrating a state where the precursor is detached from the first support substrate, is turned upside down again, and then, is pasted on the adhesion layer of a second support substrate based on the state illustrated in FIG. 20.

First, as illustrated in FIG. 22, after preparing a second support substrate 85 in which the adhesion layer 85B is formed on the substrate main body 85A, the precursor 75 which is detached from the first support substrate 80 is turned upside down again. Then, in the silicon substrate 70, a surface on a side opposite to a side where the silicon oxide film 71 is formed is laminated on the adhesion layer 85B.

Figure 23:
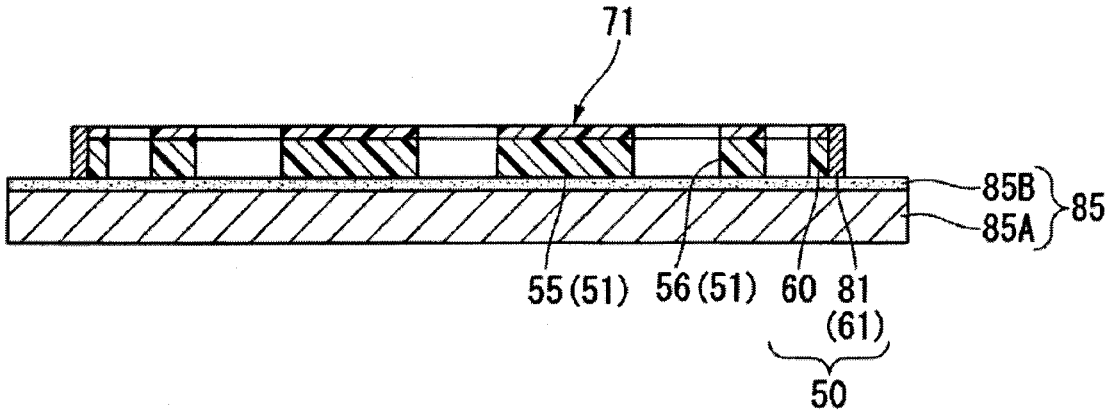
FIG. 23 is a cross-sectional view illustrating a state where a guide wall for electrocasting is removed based on the state illustrated in FIG. 22.

Subsequently, as illustrated in FIG. 23, only the guide wall 70A for electrocasting is selectively removed from the precursor 75. Specifically, in the precursor 75, a region other than the guide wall 70A for electrocasting is covered with a mask (not illustrated) from above for example, and the guide wall 70A for electrocasting which is not masked is removed through the etching processing by the dry etching such as the deep reactive ion etching (DRIE).

At this stage, the step of removing ends.

Figure 24:
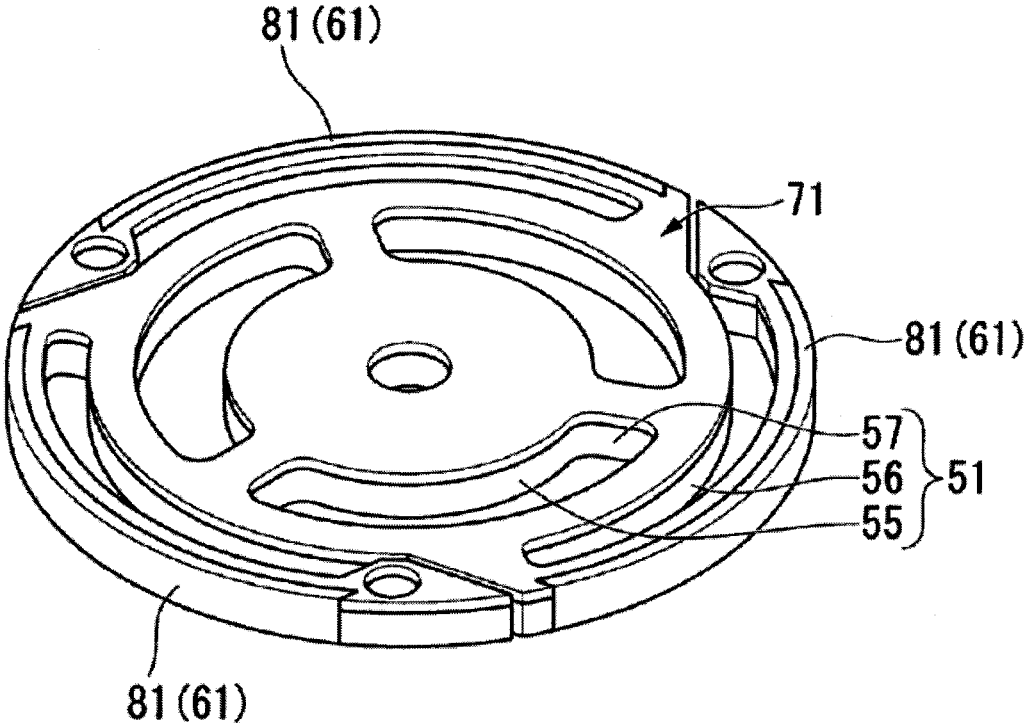
FIG. 24 is a perspective view illustrating a state where the second support substrate is detached based on the state illustrated in FIG. 23.
Figure 25:
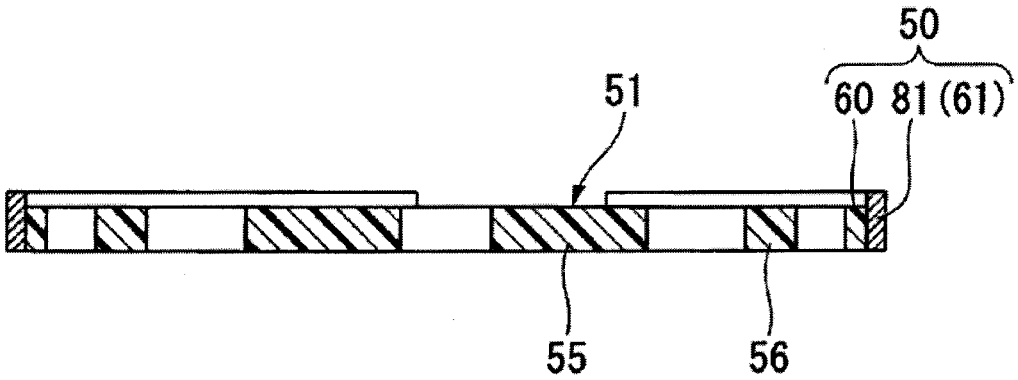
FIG. 25 is a cross-sectional view illustrating a state where the silicon oxide film is removed based on the state illustrated in FIG. 24.
Figure 26:
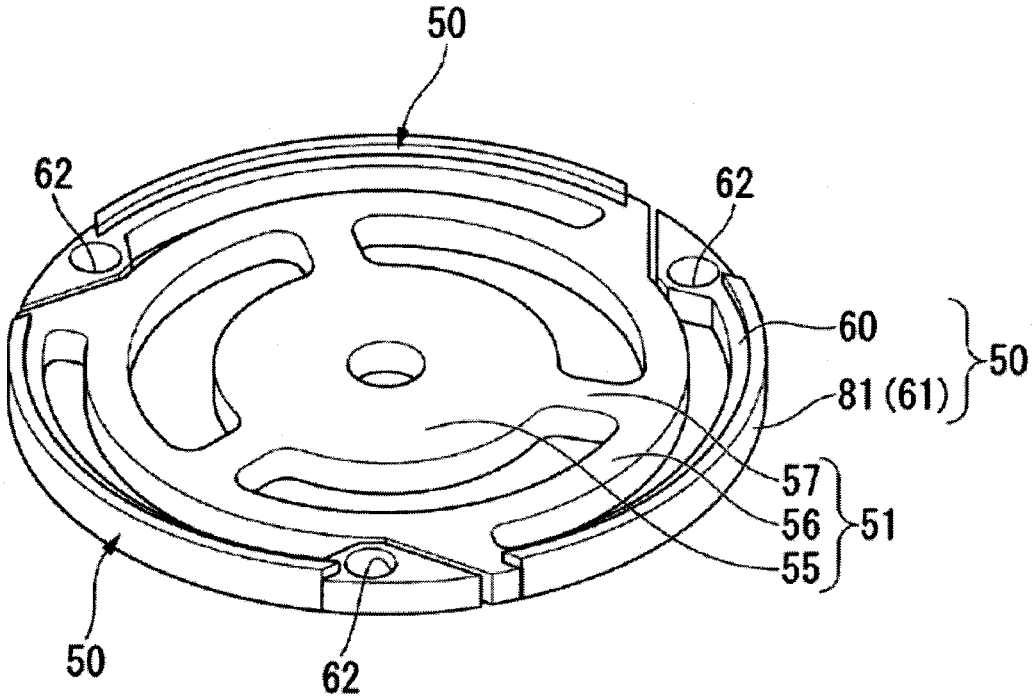
FIG. 26 is a perspective view in a state illustrated in FIG. 25.

Subsequently, as illustrated in FIG. 24, after the second support substrate 85 is detached, as illustrated in FIGS. 25 and 26, the remaining silicon oxide film 71 is removed by wet etching using BHF for example.

The silicon oxide film 71 is not necessarily to be removed but is preferable to be removed. In addition, in FIGS. 25 and 26, since the film thickness of the silicon oxide film 71 is exaggerated in the drawing, a step difference is generated between the first member 60 and the second member 61. However, the quantity of the step difference is insignificant (for example, approximately 1 μm), thereby being practically equivalent to not having the step difference between the first member 60 and the second member 61 as illustrated in FIG. 3.

Then, finally, the weight portion 65 is fixed to be in the weight hole 62 by the press-fitting, and thus, it is possible to manufacture the balance wheel 42 illustrated in FIG. 2.

Thereafter, as previously described, the balance staff 41 and the hairspring 43 which are separately manufactured are assembled to be integrated with the balance wheel 42, thereby completing the manufacturing of the balance 40.

(Operation Effect)

As described above, according to the balance 40 of the embodiment, the first member 60 of the bimetal portion 50 is formed of the ceramic material, thereby suppressing the bimetal portion 50 from elastically deforming. Even if the deformation of the free end 50B is repeated due to the temperature correction, it is possible to form the bimetal portion 50 with time-dependently stable precision.

In addition, in the bimetal portion 50 configured to include the first member 60 and the second member 61 which are radially overlapped with each other, since the inward first member 60 is formed of the ceramic material, the thermal deformation of the first member 60 caused by the temperature change is suppressed, and thus, the deformation of the bimetal portion 50 which is associated with the temperature change is suppressed to be low, and it is possible to obtain a desired adjustment volume in the moment of inertia. That is, since the inward member of the bimetal portion 50 is made of the ceramic material but the metal, it is possible to design a deformation volume of the free end 50B of the bimetal portion 50 without excessively considering the thermal deformation volume of the inward member. Therefore, the temperature correction for the moment of inertia can be easily performed, thereby enabling correction precision to be improved.

In addition, when ensuring an adjustment range of the desired moment of inertial, since the deformation volume of the free end 50B of the bimetal portion 50 can be reduced, an opening (space interposed by the bimetal portion 50 and the connection member 51 therebetween) surrounding the free end 50B can be reduced, thereby enabling the balance 40 to be formed with high density.

Accordingly, it is possible to ensure desired rigidity in the balance which is formed of the ceramic material.

In addition, since the highly dense bimetal portion 50 is formed only on the outermost periphery, it is possible to suppress the overall weight and obtain the desired moment of inertia. That is, the silicon material (ceramic material) is used to suppress the weight of the balance 40, and thus, it is possible to reduce a shock applied to the balance staff 41 when the timepiece is dropped. Accordingly, the frequency of occurrence in bending of the balance staff or breaking of the balance staff is suppressed, and it is possible to improve the reliability as a timepiece.

In addition, in the balance wheel 42, the connection member 51 and the first member 60 are formed of the silicon to be integrated with each other, it is possible to form the connection member 51 and the first member 60 to be integrated with each other in the excellent form precision from the silicon substrate 70 by utilizing a semiconductor manufacturing technology (technology including photolithography technique and etching processing technology). Besides, utilizing the semiconductor manufacturing technology enables the connection member 51 and the first member 60 to be formed in a desired minute shape without applying an unnecessary external force thereto.

Meanwhile, the second member 61 configuring the bimetal portion 50 is the electrocast, thereby being able to be bonded to the first member 60 through easy work of simply spreading the gold by electrocasting. Therefore, unlike a method of brazing or crimping in the related art, still without applying the unnecessary external force to the first member 60, the second member 61 can be bonded thereto. Therefore, in addition to preventing the elastic deformation of the bimetal portion 50, it is possible to form the bimetal portion 50 with the excellent form precision. Besides, the ceramic material including the silicon is unlikely to be elastically deformed. In this respect as well, it is possible to prevent the elastic deformation of the bimetal portion 50.

As described above, since the bimetal portion 50 can be formed with the excellent form precision while preventing the elastic deformation, the temperature correction work can be stably performed as intended, and thus, it is possible to provide a high quality balance 40 that is unlikely to vary in the rate influenced by the temperature change and excels in the temperature compensation performance.

In addition, the shape of the bimetal portion 50 can be controlled, thereby enabling a degree of freedom in the shape of the bimetal portion 50 to be enhanced. For example, the volume of the temperature compensation is likely to be controlled by increasing the displacement.

Furthermore, when manufacturing the balance wheel 42, in addition to the connection member 51 and the first member 60, the precursor 75 is formed to which the guide wall 70A for electrocasting is formed to be integrated therewith. Therefore, the open space S for electrocasting defined between the guide wall 70A for electrocasting and the first member 60 can be formed with the excellent form precision. Then, at the time of the electrocasting, the second member 61 is formed by spreading the gold in the open space S for electrocasting, thereby enabling the second member 61 to be formed with the excellent form precision. As a result, it is possible to obtain the high quality bimetal portion 50 having the desired shape.

In this manner, it is possible to more markedly exhibit the above-described operation.

In addition, the connection member 51 and the first member 60 are made of the silicon, thereby being unlikely to rust, even if plating is not performed. Additionally, the second member 61 is formed of gold, thereby being excellent in rust prevention. According to these, there is no need of a step of plating, thereby enabling the efficient manufacturing.

In addition, since the first member 60 and the second member 61 configuring the bimetal portion 50 are engaged with each other by the engagement of the wedge portion 67 and the concave portion 68 as well, the bonding intensity therebetween can be enhanced, thereby enabling the operational reliability as the bimetal portion 50 to be improved. In addition, the engagement therebetween determines a position of the second member 61 in the circumferential direction with respect to the first member 60, and thus, the second member 61 can be bonded to the region lead by the first member 60. In this respect as well, it is possible to improve the operational reliability as the bimetal portion 50.

The movement 10 according to the embodiment is provided with the above-described temperature compensation-type balance 40 having the high temperature compensation performance, and thus, it is possible to provide a high quality movement having few errors in the rate.

Furthermore, according to the mechanical timepiece 1 of the embodiment which is provided with the movement 10, it is possible to provide a high quality timepiece having few errors in the rate.

Modification Example

In the embodiment, although the weight portion 65 is provided at the free end 50B of the bimetal portion 50, the weight portion 65 is not a requirement and may be excluded. However, since the weight of the free end 50B can be increased by providing the weight portion 65, the temperature correction for the moment of inertia can be performed more effectively with respect to the change volume of the free end 50B in the radial direction, and thus, it is likely to be improved in the temperature compensation performance.

A shape of the weight portion 65 may be determined by the weight of the weight portion 65 and the volume of the moment of inertia that is required for the weight portion 65.

In addition, when providing the weight portion 65, the weight portion 65 is not limited to the one fixed to be in the weight hole 62 as in the embodiment by the press-fitting and may be freely changed.

Figure 27:
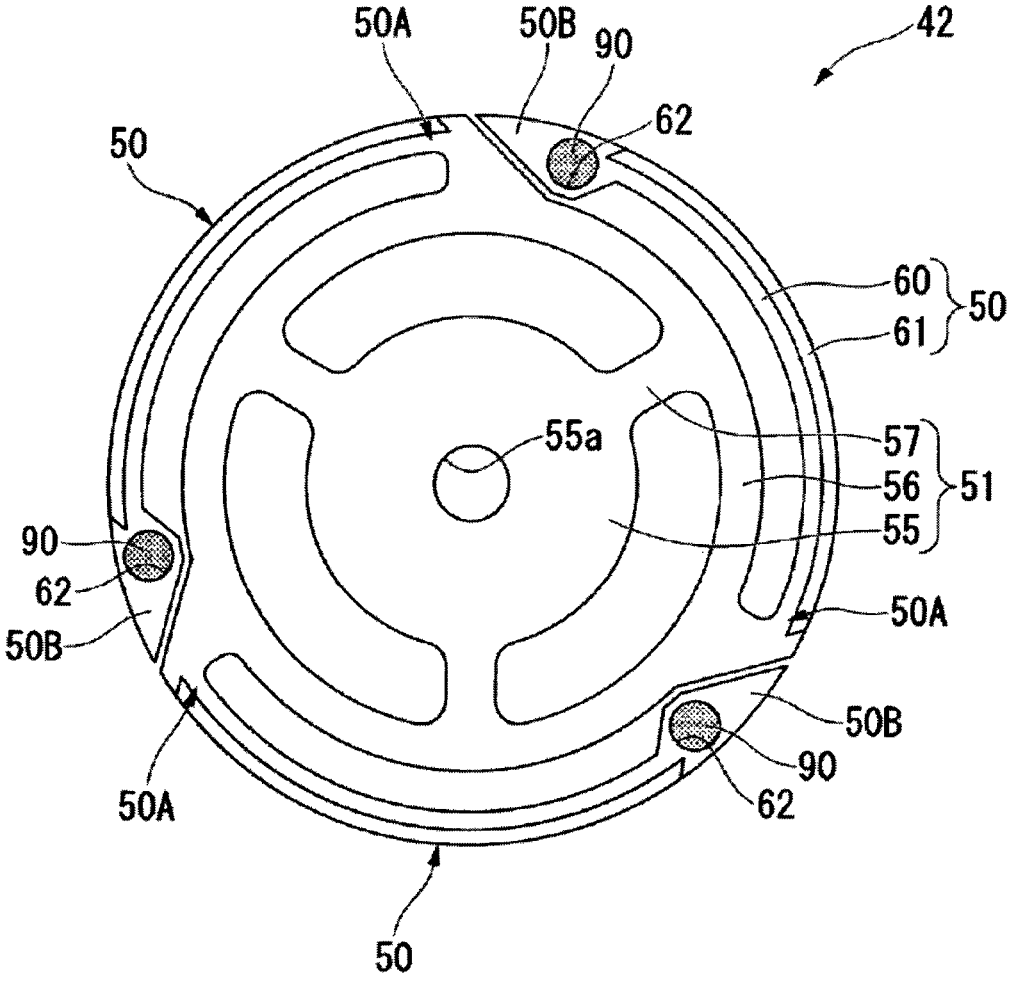
FIG. 27 is a perspective view illustrating a modification example of the balance wheel according to the invention.

For example, as illustrated in FIG. 27, an electrocast in which the gold is spread in the weight hole 62 by the electrocasting may be provided as a weight portion 90.

In this case, a portion of the adhesion layer 85B is removed at the time of manufacturing, and when exposing the electrode layer 80B to the open space S for electrocasting, the adhesion layer 85B of the portion corresponding to the weight portion 62 is removed simultaneously with the exposing of the electrode layer 80B. Then, when forming the second member 61 by spreading the gold through the electrocasting, the weight portion 90 may be formed by simultaneously spreading the gold in the weight hole 62.

In this manner, the second member 61 and the weight portion 90 can be simultaneously formed through one step of the electrocasting, and thus, it is possible to further enhance the manufacturing efficiency. In addition, it is possible to form the weight portion 90 without applying the external force to the free end 50B of the bimetal portion 50, thereby being more preferable.

In addition, in the above embodiment, although a case is described in which the wedge portions 67 provided on both end portions of the second member 61 in the circumferential direction are in a state of being engaged with the concave portion 68 on the first member 60 side, and the first member 60 and the second member 61 are bonded to each other, the engagement of the wedge portion 67 and the concave portion 68 is not a requirement and may be excluded. However, since the engagement enhances the bonding intensity and enables the second member 61 to be regulated so as not to be peeled off from the first member 60 and to be displaced neither radially nor circumferentially with respect to the first member 60, it is preferable to provide the engagement therebetween.

In place of the wedge portion 67 and the concave portion 68, different engagement member may be provided for the first member 60 and the second member 61, or in place of the wedge portion 67 and the concave portion 68, different engagement member may be added to the first member 60 and the second member 61.

Figure 28:
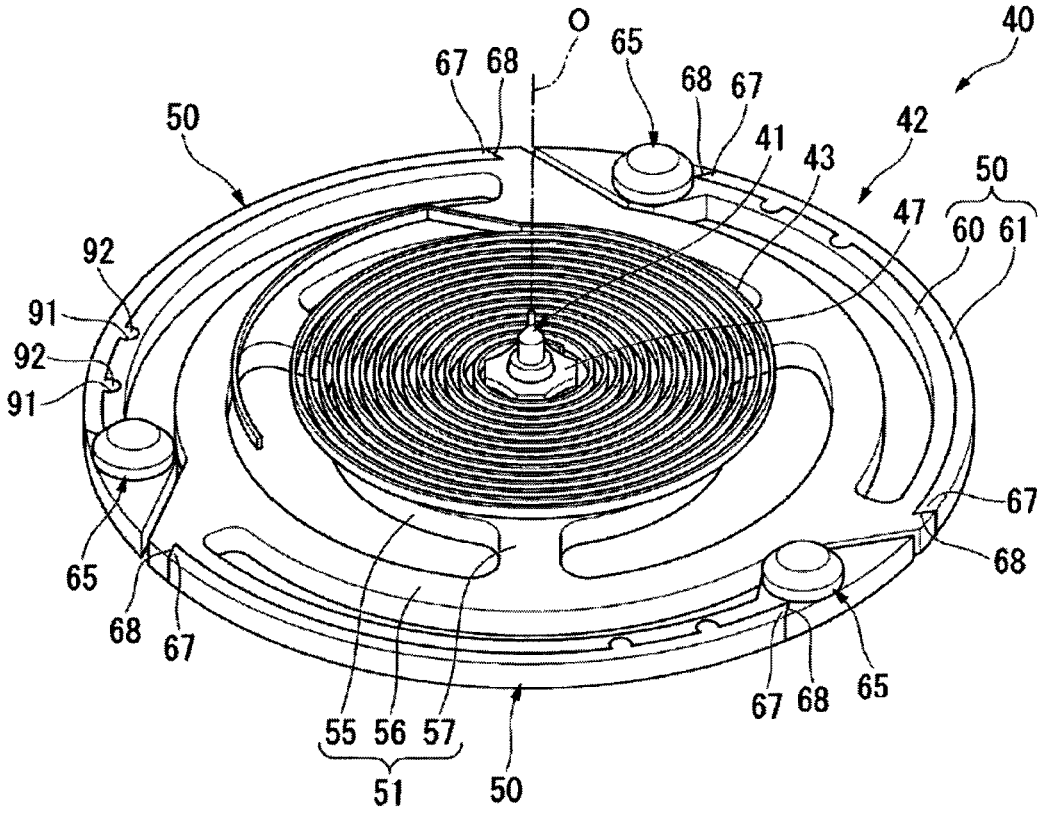
FIG. 28 is a perspective view illustrating a modification example of the balance according to the invention.
Figure 29:
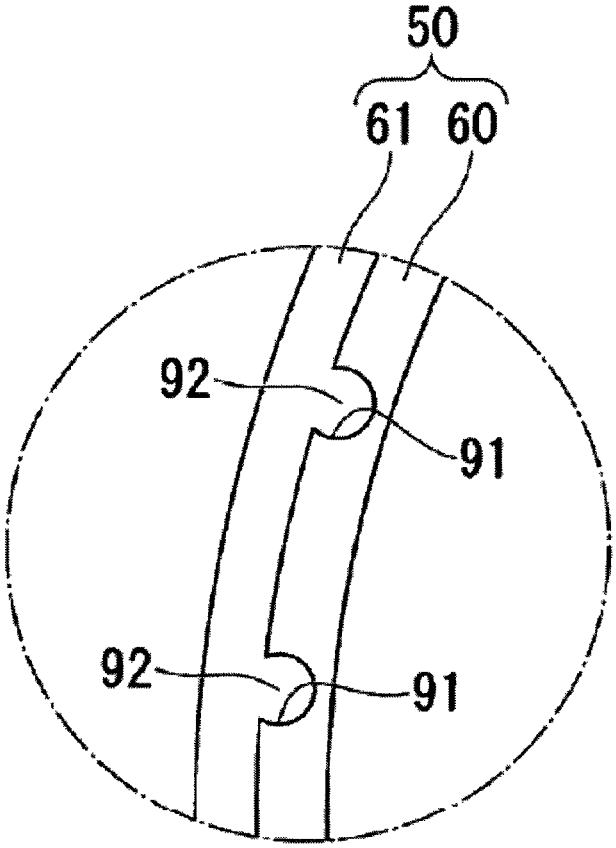
FIG. 29 is an enlarged top view of the bimetal portion in the balance illustrated in FIG. 28.

For example, as illustrated in FIGS. 28 and 29, two engagement concave portions (first engagement portion) 91 that are radially open outward on the outer peripheral portion of the first member 60 may be provided by being spaced with an interval in the circumferential direction, and two engagement convex portions (second engagement portion) 92 that protrude radially inward on the inner periphery portion of the second member 61 and engage with the engagement concave portion 91 may be provided by being spaced with an interval in the circumferential direction.

In this manner, it is possible to enhance the bonding intensity between the first member 60 and the second member 61 by further adding the engagement concave portions 91 and the engagement convex portions 92, thereby being more preferable. The number of the engagement concave portions 91 and the engagement convex portions 92 are not limited to two.

Figure 30:
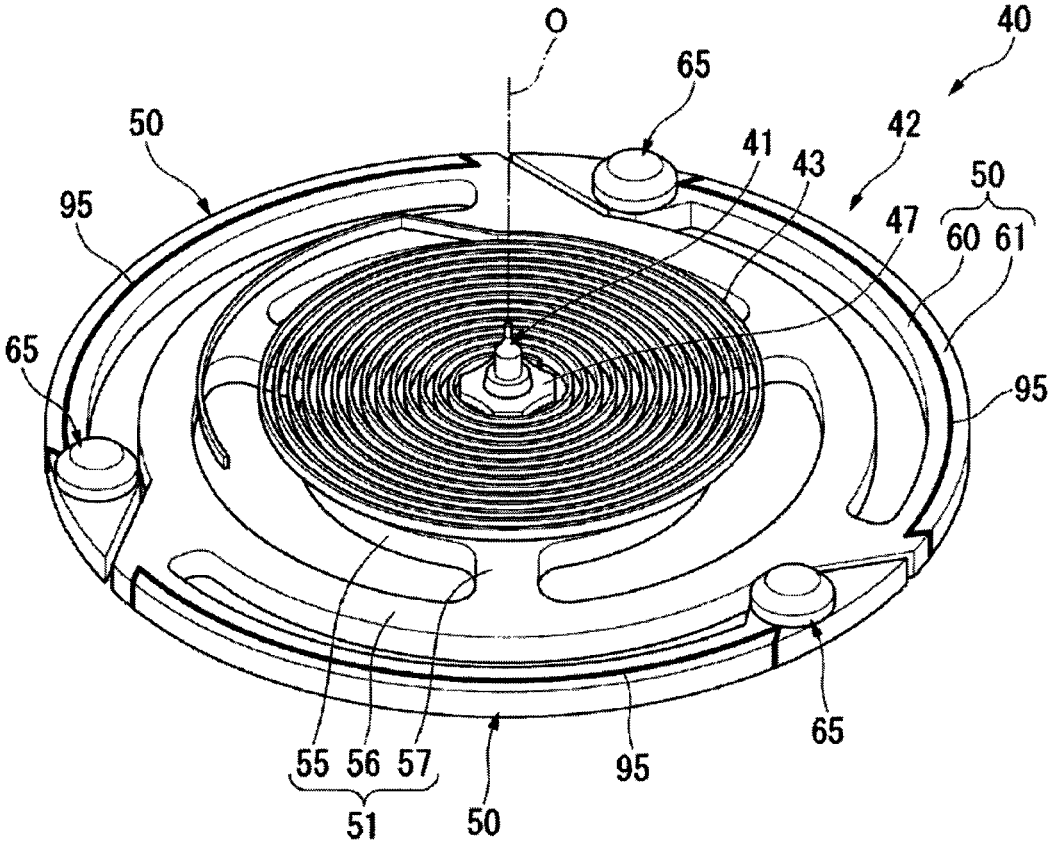
FIG. 30 is a perspective view illustrating another modification example of the balance according to the invention.
Figure 31:
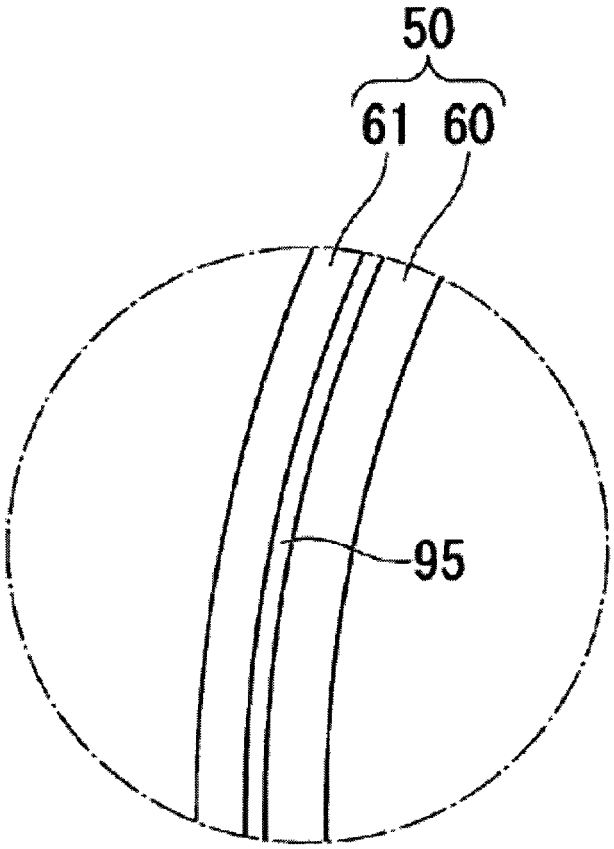
FIG. 31 is another enlarged top view of the bimetal portion in the balance illustrated in FIG. 30.

In addition, as illustrated in FIGS. 30 and 31, the first member 60 and the second member 61 may be bonded with each other via an alloy layer 95.

When forming the alloy layer 95, after the second member 61 is formed through the step of electrocasting, a step of heat treatment is performed in which the precursor 75 having the bimetal portion 50 formed therein is heat-treated during a predetermined period at a predetermined temperature atmosphere. It is possible to diffuse the gold forming the second member 61 which is the electrocast along a bonding interface with respect to the first member 60 by performing the heat treatment in such a manner, and thus, it is possible to form the alloy layer 95 between the first member 60 and the second member 61 by utilizing this diffusion.

Even in this case, it is also possible to enhance the bonding intensity between the first member 60 and the second member 61. Therefore, it is possible to improve the operational reliability as the bimetal portion 50.

As the time to be performed, the heat treatment may be performed any time as long as it is after the step of electrocasting. The heat treatment may be performed before removing the guide wall 70A for electrocasting or may be performed after removing the same. However, since the alloy layer 95 is also formed between the guide wall 70A for electrocasting and the second member 61 by the heat treatment, it is preferable that the heat treatment be performed after removing the guide wall 70A for electrocasting.

In addition, in a case of the above-described embodiment, since the first member 60 is formed of the silicon, and the second member 61 is formed of the gold, it is possible to perform the heat treatment at a temperature of approximately 1,000° C. In addition, the heat treatment can be also performed in the atmosphere. However, in order to prevent oxidization, it is preferable to perform the heat treatment in a vacuum atmosphere, an argon gas atmosphere or a nitrogen gas atmosphere.

A technical scope of the invention is not limited to the above-described embodiment, and various modifications can be added thereto without departing from the gist of the invention.

For example, in the above-described embodiment, there are provided three bimetal portions 50. However, the number may be two or may be more than four. Even in these cases, it is possible to achieve the similar operation effect by uniformly disposing each of the bimetal portions 50 in the circumferential direction. In addition, a shape of the connection member 51 is merely an example and may be appropriately modified.

In addition, in the above-described embodiment, a constant elastic material such as Elinvar as the material of the hairspring 43 may be employed, and the second member 61 in the bimetal portion 50 may be formed of a metal material having a lower thermal expansion coefficient than the first member 60 formed of the ceramic material. Even in this case, it is also possible to minutely adjust the temperature characteristics of the moment of inertia so as to cancel the positive temperature coefficient of the hairspring 43.

In addition, in the above-described embodiment, the silicon is employed to form the connection member 51 and the first member 60 configuring the balance wheel 42. However, the material is not limited to the silicon as long as the connection member 51 and the first member 60 are formed of a ceramic material.

For example, as the ceramic material, silicon carbide (SiC), silicon dioxide ($SiO_2$), sapphire, alumina ($Al_2O_3$), zirconia ($ZrO_2$), glassy carbon (C) and the like may be employed. Even if any one of these is employed, it is possible to perform the etching processing, particularly, possible to preferably perform the dry etching processing. Therefore, it is possible to more easily and efficiently form the connection member 51 and the first member 60, and thus, it is likely to further enhance the manufacturing efficiency. In addition, for example, the first member 60 can be formed of a metal material other than the ceramic material. For example, an alloy having a low thermal expansion coefficient such as Invar can be used.

It is preferable that the ceramic material in the embodiment have an insulation property with high electrical resistance. In addition, on the front surface of the connection member 51 and the first member 60, a coating film such as an oxide film or a nitride film may be processed, for example.

In addition, the gold is employed to form the second member 61 configuring the balance wheel 42. However, the material is not limited to the gold as long as the second member 61 has a different (preferably larger) thermal expansion coefficient from that of the first member 60 and is a metal material which can be subject to the electrocasting.

For example, Au, Ni, an Ni alloy (such as Ni—Fe), Sn, a Sn alloy (such as Sn—Cu) and the like may be employed. Even if any one of these is employed, it is possible to smoothly spread the metal material through the electrocasting, thereby enabling the second member 61 to be efficiently formed. In addition, for example, the second member 61 can be a material having a higher thermal expansion coefficient than the above-described metal and the alloy. For example, stainless steel, brass and the like having a higher thermal expansion coefficient than the above-described Invar can be used.

Particularly, even if any one of the above-described metal material is employed, it is possible to form the alloy layer 95 by the heat treatment. In such a case, the silicon (Si) and the silicon carbide (SiC) are particularly preferable to be combined as the ceramic material for the first member 60 side.

In a case of having the above-described combination, FIG. 32 shows preferable heat treatment temperatures at the time of the step of heat treatment. It is possible to form the alloy layer 95 which is sufficient for enhancing the bonding intensity by performing the heat treatment at the heat treatment temperatures shown in FIG. 32.

In the embodiment, although the weight portion 65 is provided at the free end 50B of the bimetal portion 50, the weight portion 65 is not a requirement and may be excluded. However, since the weight of the free end 50B can be increased by providing the weight portion 65, the temperature correction for the moment of inertia can be performed more effectively with respect to the change amount in radius of the free end 50B, and thus, it is likely to be improved in the temperature compensation performance.

A shape of the weight portion 65 may be determined by the weight of the weight portion 65 and the volume of the moment of inertia that is required for the weight portion 65.

In addition, when providing the weight portion 65, the weight portion 65 is not limited to the one fixed to be in the weight hole 62 as in the embodiment by the press-fitting and may be freely changed. For example, an electrocast in which the gold is spread in the weight hole 62 by the electrocasting may be provided as a weight portion.

In addition, in the embodiment, the configuration is described in which both the first member 60 and the second member 61 become gradually thinner as being from the fixed end 50A side toward the free end 50B side. However, without being limited thereto, it is applicable as long as the overall thickness of the bimetal portion 50 becomes gradually thinner as being from the fixed end 50A side toward the free end 50B side. That is, at least only one between the first member 60 and the second member 61 (preferably first member 60) may be formed to be gradually thinner as being from the fixed end 50A side toward free end 50B side in the configuration.

Furthermore, the first member 60 and the second member 61 may be equal to each other in thickness, or either one may be thicker than the other. However, it is preferable to cause the material with the high Young's modulus to be thinner between the first member 60 and the second member 61.

In addition, in the above-described embodiment, a case is described in which the thickness ratio of the first member 60 to the second member 61 is uniformly set throughout the overall bimetal portion 50 in the circumferential direction. However, without being limited thereto, it may be set to cause the thickness ratio to change along the circumferential direction.

In addition, when the first member 60 is formed of a metal material having the low thermal expansion coefficient such as the Invar, other than the ceramic material, and the second member 61 is formed of the stainless steel, the brass or the like having the large thermal expansion coefficient, it is possible to form outer shapes thereof through machining, etching, laser beam machining and the like. In addition, the first member 60 and the second member 61 may be separately formed, and the first member 60 and the second member 61 may be bonded by fitting, glueing, welding or the like.

As described above, it is possible to provide a temperature compensation-type balance which first ensures intensity and can ensure the necessary temperature correction amount of the moment of inertia, a timepiece movement which is provided with the same and a mechanical timepiece.

Besides, in a range without departing from the spirit of the invention, it is possible to appropriately replace the configuring elements in the above-described embodiment with well-known configuring elements, and each of the above-described modification examples may be appropriately combined.

What is claimed is:

1. A temperature compensation-type balance comprising:

a balance staff that rotates about a rotation axis; and a balance wheel that has a plurality of bimetal portions which are disposed in parallel to each other in a circumferential direction around the rotation axis of the balance staff and extended in an arc shape along the circumferential direction of the rotation axis, and connection members which radially connect respective ones of the plurality of bimetal portions to the balance staff, wherein each bimetal portion is a layered body in which a first member and a second member that is disposed more radially outward than the first member are radially overlapped, one end portion of the bimetal portion in the circumferential direction is a fixed end connected to a respective connection member and the other end portion of the bimetal portion in the circumferential direction is a free end, and the second member has a second V-shaped engagement portion that is engaged with a first V-shaped engagement portion formed in the first member at the free end of the bimetal portion and is bonded to the first member to maintain the engagement therebetween the first member is formed of a ceramic material, and the second member is formed of a metal material having a thermal expansion coefficient different from that of the first member.

2. The temperature compensation-type balance according to claim 1, wherein the first members and the connection members comprise a one-piece structure made of the ceramic material, and the second members comprise an electrocast made of the metal material having the thermal expansion coefficient different from that of the first member.

3. The temperature compensation-type balance according to claim 2, wherein the first member and the second member of each bimetal portion are bonded via an alloy layer.

4. The temperature compensation-type balance according to claim 2, wherein a weight portion is provided at the free end of each bimetal portion.

5. The temperature compensation-type balance according to claim 2, wherein the first members and the connection members are formed of any material among Si, SiC, $SiO_2$, $Al_2O_3$, $ZrO_2$ and C.

6. The temperature compensation-type balance according to claim 1, wherein the second member of each bimetal portion is formed of any material among Au, Cu, Ni, an Ni alloy, Sn and a Sn alloy.

7. The temperature compensation-type balance according to claim 1, wherein each bimetal portion becomes gradually thinner in thickness along the radial direction from the fixed end side toward the free end side.

8. The temperature compensation-type balance according to claim 7, wherein in each bimetal portion:

the first member is disposed more radially inward than the second member and is formed of a ceramic material integrated with the connection member, and at least the first member between the first member and the second member becomes gradually thinner in thickness along the radial direction from the fixed end side toward the free end side.

9. The temperature compensation-type balance according to claim 7, wherein in each bimetal portion, a thickness ratio of the first member to the second member in the radial direction is uniform from the fixed end side to the free end side.

10. The temperature compensation-type balance according to claim 7, wherein a weight portion is provided at the free end of each bimetal portion.

11. The temperature compensation-type balance according to claim 1, wherein the first member and the second member of each bimetal portion are bonded via an alloy layer.

12. The temperature compensation-type balance according to claim 1, wherein a weight portion is provided at the free end of each bimetal portion.

13. The temperature compensation-type balance according to claim 1, wherein the first member of each bimetal portion and respective connection member are formed of any material among Si, SiC, $SiO_2$, $Al_2O_3$, $ZrO_2$ and C.

14. The temperature compensation-type balance according to claim 1, wherein the second member of each bimetal portion is formed of any material among Au, Cu, Ni, an Ni alloy, Sn and a Sn alloy.

15. A timepiece movement comprising:

a movement barrel that has a power source;

a train wheel that transfers a rotational force of the movement barrel;

an escapement mechanism that controls rotations of the train wheel; and the temperature compensation-type balance according to claim 1 for controlling the speed of the escapement mechanism.

16. A mechanical timepiece comprising:

the timepiece movement according to claim 15.

17. The temperature compensation-type balance according to claim 1, wherein in each bimetal portion, the second member has a convex engagement portion that is engaged with a concave engagement portion formed in the first member.

* * * * *